US012331443B2

(12) United States Patent
Hallstedt et al.

(10) Patent No.: US 12,331,443 B2
(45) Date of Patent: Jun. 17, 2025

(54) METHOD AND APPARATUS FOR AUTO THREAD COLOR CHANGE

(71) Applicant: INTEVA PRODUCTS, LLC, Troy, MI (US)

(72) Inventors: Nicholas Hallstedt, Sterling Heights, MI (US); Ramez Habhab, Rochester Hills, MI (US); Edward J. Wenzel, Troy, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 14 days.

(21) Appl. No.: 17/889,893

(22) Filed: Aug. 17, 2022

(65) Prior Publication Data

US 2023/0053535 A1 Feb. 23, 2023

Related U.S. Application Data

(60) Provisional application No. 63/351,229, filed on Jun. 10, 2022, provisional application No. 63/234,154, filed on Aug. 17, 2021.

(51) Int. Cl.
*D05B 55/10* (2006.01)
*D05B 19/14* (2006.01)

(52) U.S. Cl.
CPC ..... *D05B 55/10* (2013.01); *D05B 19/14* (2013.01)

(58) Field of Classification Search
CPC ..... D05B 55/10; D05B 55/14; D05B 55/16; D05B 19/14
See application file for complete search history.

(56) References Cited

U.S. PATENT DOCUMENTS

| | | | | |
|---|---|---|---|---|
| 250,325 | A * | 11/1881 | Cornely | D05B 3/02 112/100 |
| 1,452,632 | A * | 4/1923 | Barnett | D05C 15/00 112/260 |
| 5,390,613 | A * | 2/1995 | Shibata | D05C 11/16 112/163 |
| 6,237,515 | B1 * | 5/2001 | Noltge | D05B 47/04 112/68 |
| 10,934,648 | B2 | 3/2021 | Takahashi et al. | |
| 2010/0242819 | A1 | 9/2010 | Fukao | |
| 2014/0283723 | A1 | 9/2014 | Ueda et al. | |
| 2014/0290548 | A1 | 10/2014 | Chen | |

FOREIGN PATENT DOCUMENTS

EP 2806059 B1 12/2016

OTHER PUBLICATIONS

International Search Report and Written Opinion; Issued: Dec. 6, 2022, International Application No. PCT/US2022/040603, Filed Aug. 17, 2022; 11 pages.
PCT International Preliminary Report on Patentability for International Application No. PCT/US2022/040603; Mailing Date, Feb. 29, 2024.
Italian Office Action corresponding to IT Application No. 112024000031321; Issue Date, Jul. 12, 2024.

* cited by examiner

*Primary Examiner* — Nathan E Durham
(74) *Attorney, Agent, or Firm* — CANTOR COLBURN LLP

(57) ABSTRACT

A needle bar holder for a sewing machine head, including: a revolver configured to hold a plurality of separate needle bars; a motor operably coupled to the revolver for rotating the revolver; and a means for ensuring alignment and stability of the revolver when one of the plurality of separate needle bars are selected for a sewing process.

16 Claims, 27 Drawing Sheets

METHOD AND APPARATUS FOR AUTO THREAD COLOR CHANGE

CROSS REFERENCE TO RELATED APPLICATIONS

This application claims priority to the following U.S. Provisional Patent Application Ser. No. 63/234,154 filed on Aug. 17, 2021 and Ser. No. 63/351,229 filed on Jun. 10, 2022, the entire contents each of which are incorporated herein by reference thereto.

TECHNICAL FIELD

Exemplary embodiments of the present disclosure pertain to the art of three dimensional robotic sewing processes.

BACKGROUND

The 3D robot sewing process typically consists of a six-axis robot to which a sewing machine is affixed as the end effector. The robot manipulates the sewing machine as required to allow placement of a live decorative stitch on a stationary part. The process can also be arranged so that the robot moves the part in front of a stationary sewing machine to facilitate stitching.

Recent customer requests have included the need to change thread colors as frequently as part-to-part to comply with vehicle build sequencing requirements. Under current state-of-art, when a change in thread color is required from one part to the next, the robot must move the sewing head over to a service access door on the cell so that the thread spool can be manually removed and replaced with the correct color. This change required that the new thread be pulled throughout the guidance and tensioner system such that the new color thread is located all the way from the spool through to the eye of the needle. Typical time required to manually change color is about 5 min.

Alternative state-of-the-art requires installing separate sewing heads within the sewing cell for each desired thread color, which requires extra investment as well as adding considerable time to part-to-part production cycle, as the robot must move to a tool cart station every time a color change is required to uncouple one head and recouple another. Another alternative, which adds minimal cycle time but adds a substantial amount of investment, is to include multiple robots within a single cell, each with a sewing head that contains a different color thread.

BRIEF DESCRIPTION

This present disclosure addresses the need to automatically change thread colors within an automated 3D robotic sewing process.

The present disclosure described herein eliminates the need for the operator to manually change the thread spool on the robot mounted sewing head when a thread color change is required. It also eliminates the need for multiple sewing heads within a cell. In one embodiment, a single sewing head is equipped with multiple needle bars, each bar containing a different color thread, which can be arranged in a linear or circular configuration. Needle bars can be configured with either single or double needle holders depending on the desired application.

After the robotic sewing of a part is completed, the sewing head returns home and receives a signal from a human machine interface (HMI) computer (PC) indicating the color required for the next part. The sewing head then moves the needle bar rack or revolver to position the proper color needle bar in line with the lower arm hook or looper. Once the proper needle bar is in position, the sewing head then moves to position on the part to begin sewing.

Additionally, if multiple colors are required on the same part, the color change(s) will occur within a single machine cycle and executed based on commands from a robot program located upon the computer.

Disclosed is a needle bar holder for a sewing machine head, including: a revolver configured to hold a plurality of separate needle bars; a motor operably coupled to the revolver for rotating the revolver; and a means for ensuring alignment and stability of the revolver when one of the plurality of separate needle bars are selected for a sewing process.

In addition to one or more of the features described above, or as an alternative to any of the foregoing embodiments, the plurality of separate needle bars are six.

In addition to one or more of the features described above, or as an alternative to any of the foregoing embodiments, the means for ensuring alignment and stability of the revolver is a pneumatic cylinder or electric solenoid.

In addition to one or more of the features described above, or as an alternative to any of the foregoing embodiments, the pneumatic cylinder or electric solenoid extends a piston that engages one of a plurality of recesses located on the revolver.

In addition to one or more of the features described above, or as an alternative to any of the foregoing embodiments, a pneumatically actuated lifting plate configured to engage the plurality of separate needle bars is provided and wherein each of the plurality of separate needle bars has a needle bar clamp connected thereto, the pneumatically actuated lifting plate being connected to a pneumatic lift cylinder via a connecting rod, wherein one needle bar clamp is capable of being aligned with an opening of an upper shaft connecting rod clevis through rotation of the revolver and the pneumatically actuated lifting plate remains stationary while the revolver is rotated.

In addition to one or more of the features described above, or as an alternative to any of the foregoing embodiments, the pneumatically actuated lifting plate is provided with clearance slots to allow for sliding of one of the plurality of separate needle bars with respect to the pneumatically actuated lifting plate.

In addition to one or more of the features described above, or as an alternative to any of the foregoing embodiments, the plurality of separate needle bars are single or double needle bars.

Also disclosed is a sewing machine head for a robot, including: a needle bar holder, comprising: a revolver configured to hold a plurality of separate needle bars; a motor operably coupled to the revolver for rotating the revolver; and a means for ensuring alignment and stability of the revolver when one of the plurality of separate needle bars are selected for a sewing process; and a plurality of individual spools each providing an upper thread for one of the plurality of separate needle bars, wherein the upper thread is fed from one of the plurality of individual spools through a series of guides and tensioners prior to entering a top end of the needle bar holder.

In addition to one or more of the features described above, or as an alternative to any of the foregoing embodiments, each one of the plurality of separate needle bars are hollow.

In addition to one or more of the features described above, or as an alternative to any of the foregoing embodiments, each one of the plurality of needle bars serves as an upper thread take up arm, creating thread slack to allow capture by a looper or hook during stitch creation.

In addition to one or more of the features described above, or as an alternative to any of the foregoing embodiments, the upper thread that is fed from the plurality of individual spools is routed through tubing that runs from a spool mount guide bracket to a top plate of the needle bar holder, wherein the upper thread is then routed to one of a plurality of individual thread tensioners located below the top plate of the needle bar holder, and the upper thread is routed through a guide manifold after it has passed through the one of the plurality of individual thread tensioners, wherein the top plate, the plurality of individual thread tensioners and the guide manifold are configured to rotate with the revolver assembly to eliminate thread entanglement.

In addition to one or more of the features described above, or as an alternative to any of the foregoing embodiments, the plurality of separate needle bars are six.

In addition to one or more of the features described above, or as an alternative to any of the foregoing embodiments, the means for ensuring alignment and stability of the revolver is a pneumatic cylinder or electric solenoid.

In addition to one or more of the features described above, or as an alternative to any of the foregoing embodiments, the pneumatic cylinder or electric solenoid extends a piston that engages one of a plurality of recesses located on the revolver.

In addition to one or more of the features described above, or as an alternative to any of the foregoing embodiments, a pneumatically actuated lifting plate configured to engage the plurality of separate needle bars is provided and wherein each of the plurality of separate needle bars has a needle bar clamp connected thereto, the pneumatically actuated lifting plate being connected to a pneumatic lift cylinder via a connecting rod, wherein one needle bar clamp is capable of being aligned with an opening of an upper shaft connecting rod clevis through rotation of the revolver and the pneumatically actuated lifting plate remains stationary while the revolver is rotated.

In addition to one or more of the features described above, or as an alternative to any of the foregoing embodiments, the pneumatically actuated lifting plate is provided with clearance slots to allow for sliding of one of the plurality of separate needle bars with respect to the pneumatically actuated lifting plate.

In addition to one or more of the features described above, or as an alternative to any of the foregoing embodiments, the plurality of separate needle bars are single or double needle bars.

In addition to one or more of the features described above, or as an alternative to any of the foregoing embodiments, a lower post assembly configured to manage either one or two threads by automatically disabling/enabling one of two loopers of a looper arm assembly of the lower post assembly is provided, the looper arm assembly including a fixed arm and a movable arm, each supporting one of the two loopers, wherein the movable arm is lowered with respect to the fixed arm when a selected one of the plurality of separate needle bars is a single needle bar and lowering of the movable arm is accomplished by a pneumatic cylinder located near a base of the lower post assembly, the movable arm being supported by a pair of guides that allow vertical movement of the movable arm with respect to the fixed arm.

In addition to one or more of the features described above, or as an alternative to any of the foregoing embodiments, a swiper arm configured to engage a thread connected to one of the plurality of separate needle bars is provided and wherein rotational movement of the swiper arm causes the thread to be engaged by a spring clip secured to a spring clip arm that is separately secured to the revolver.

Also disclosed is a method of changing a color of thread in a sewing head without manually changing a thread spool, including: providing a single sewing head with a plurality of needle bars, each needle bar of the plurality of needle bars being mounted to a revolver and each needle bar of the plurality of needle bars containing a different color thread or threads provided by a separate individual spool or spools; and moving the revolver until a desired one of the plurality of needle bars is orientated for a sewing operation via the sewing head.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
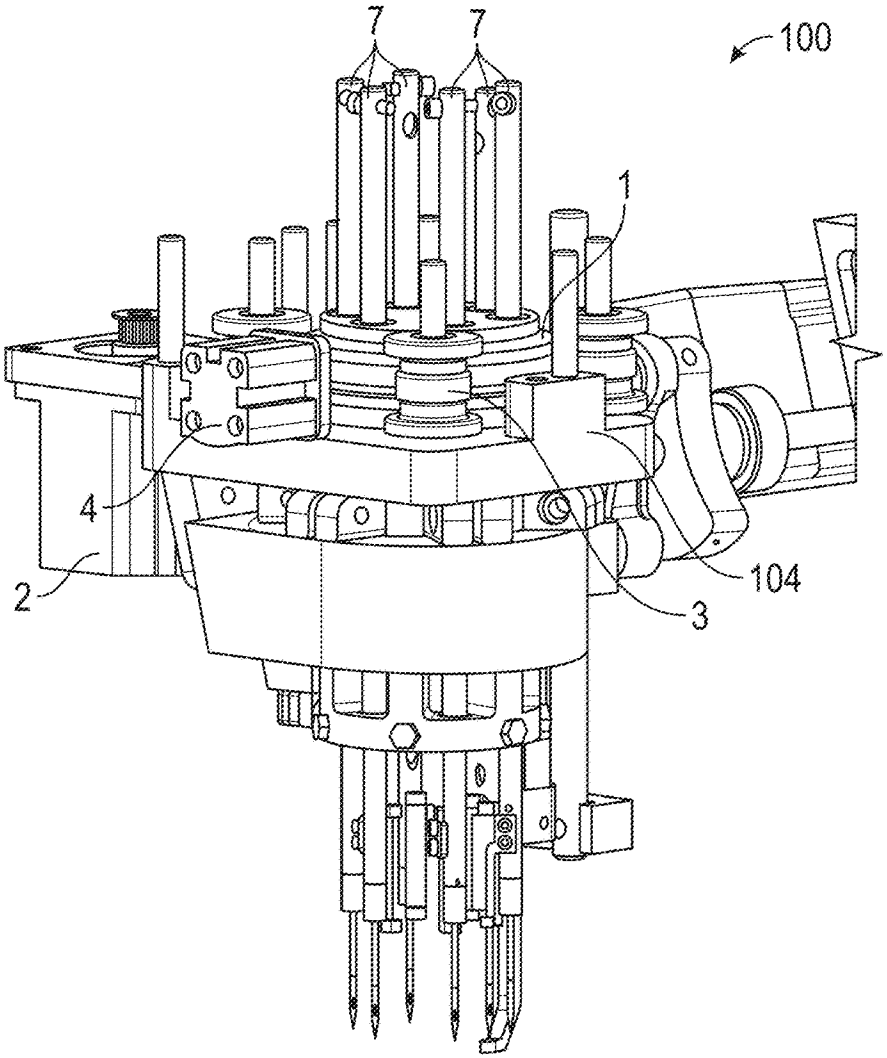
FIG. 1 is a perspective view of a revolver type needle bar holder according to the present disclosure that can hold up to six separate needle bars.
Figure 23:
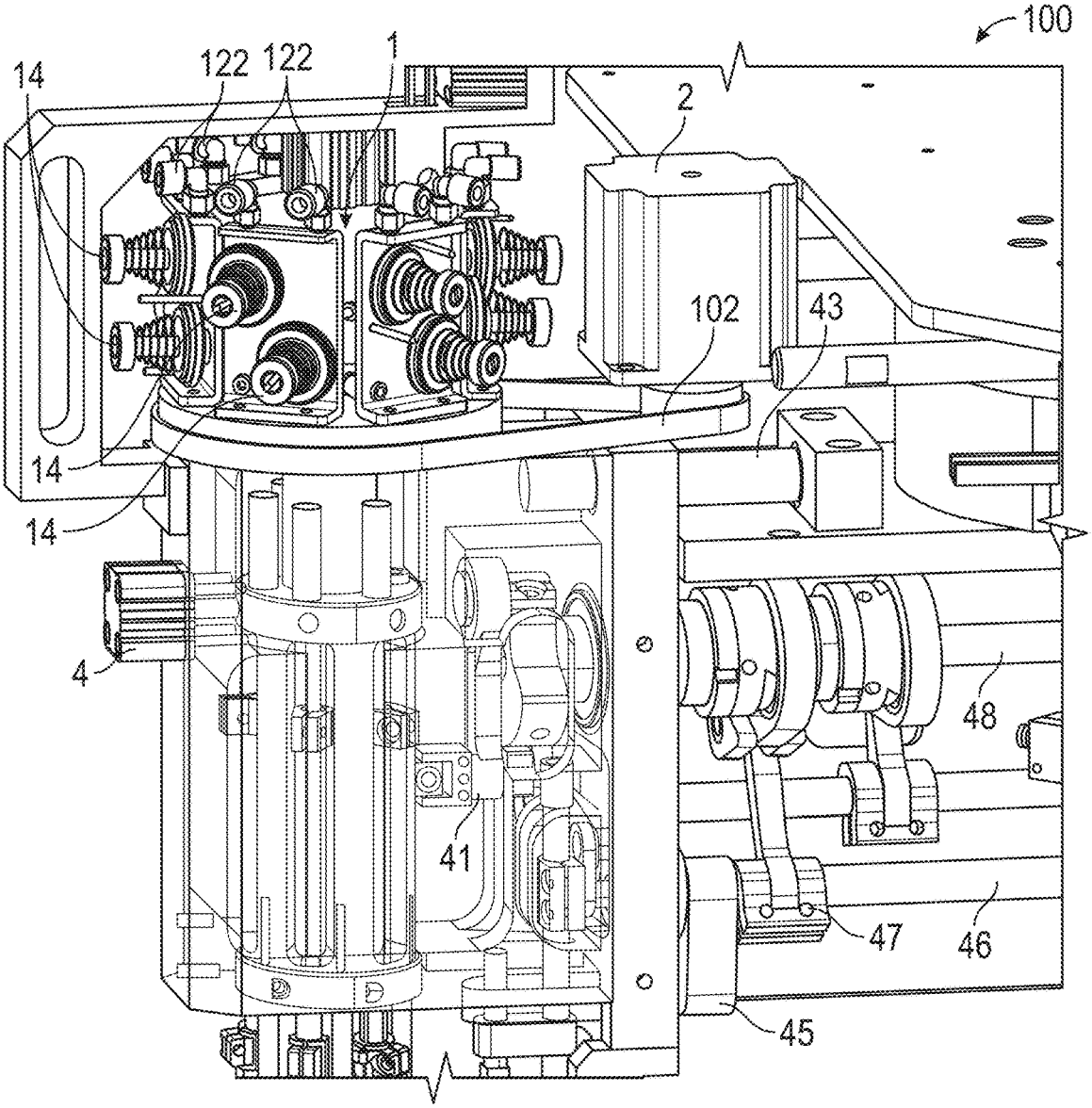
FIG. 23 is a perspective view of a portion of a sewing head in accordance with an embodiment of the present disclosure.
Figure 24:
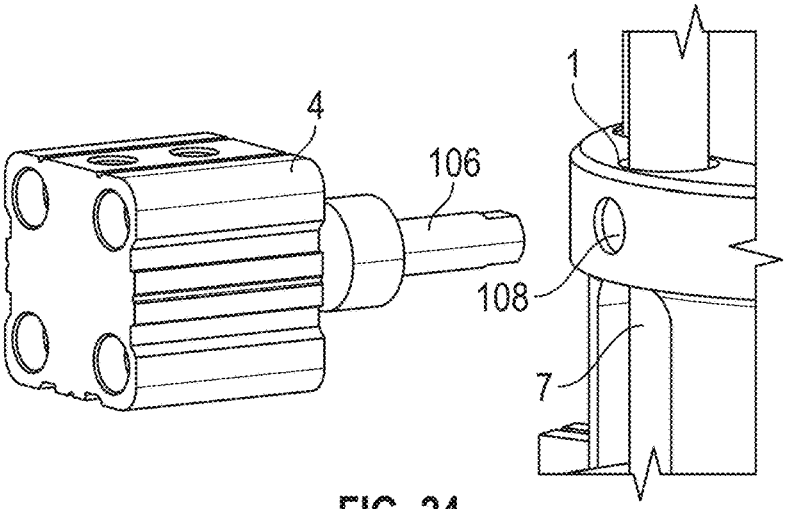
FIG. 24 is an exploded view of a portion of a sewing head in accordance with an embodiment of the present disclosure.
Figure 26:
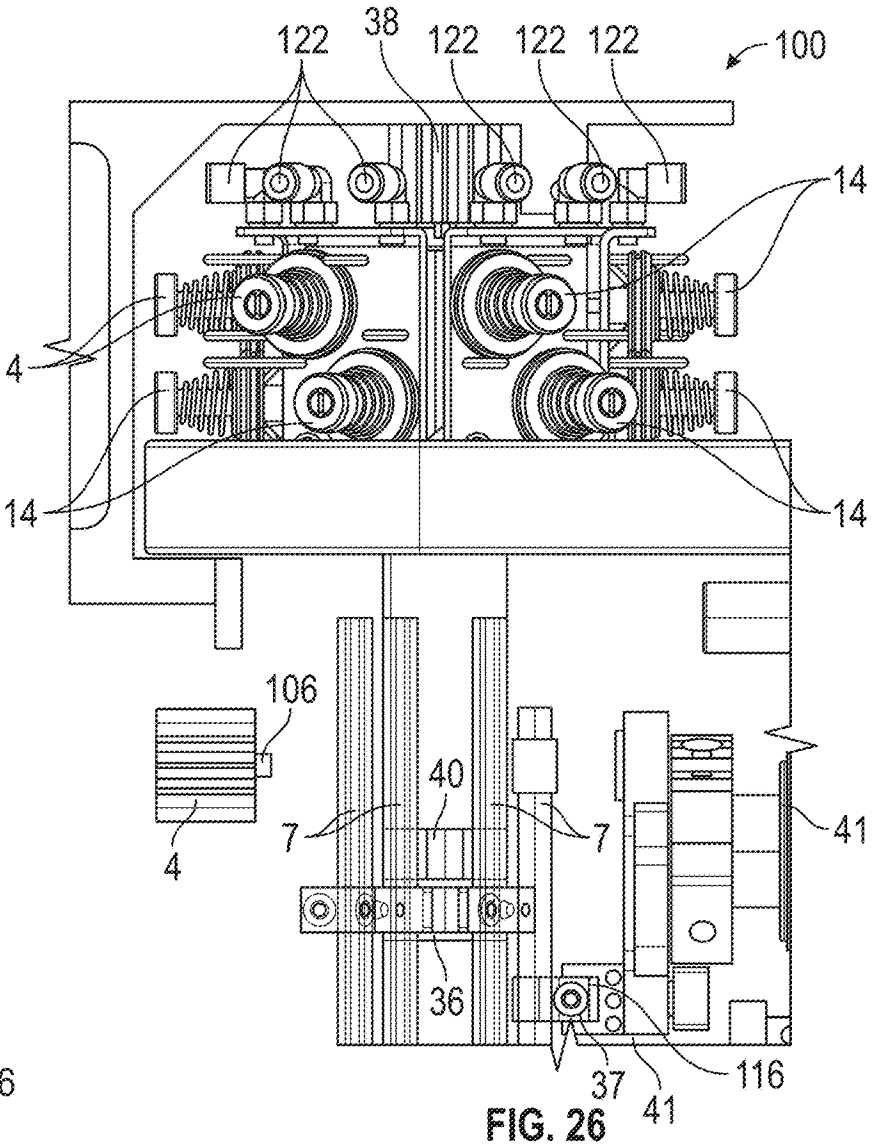
FIGS. 25 and 26 are perspective views of a portion of a sewing head in accordance with an embodiment of the present disclosure.
Figure 25:
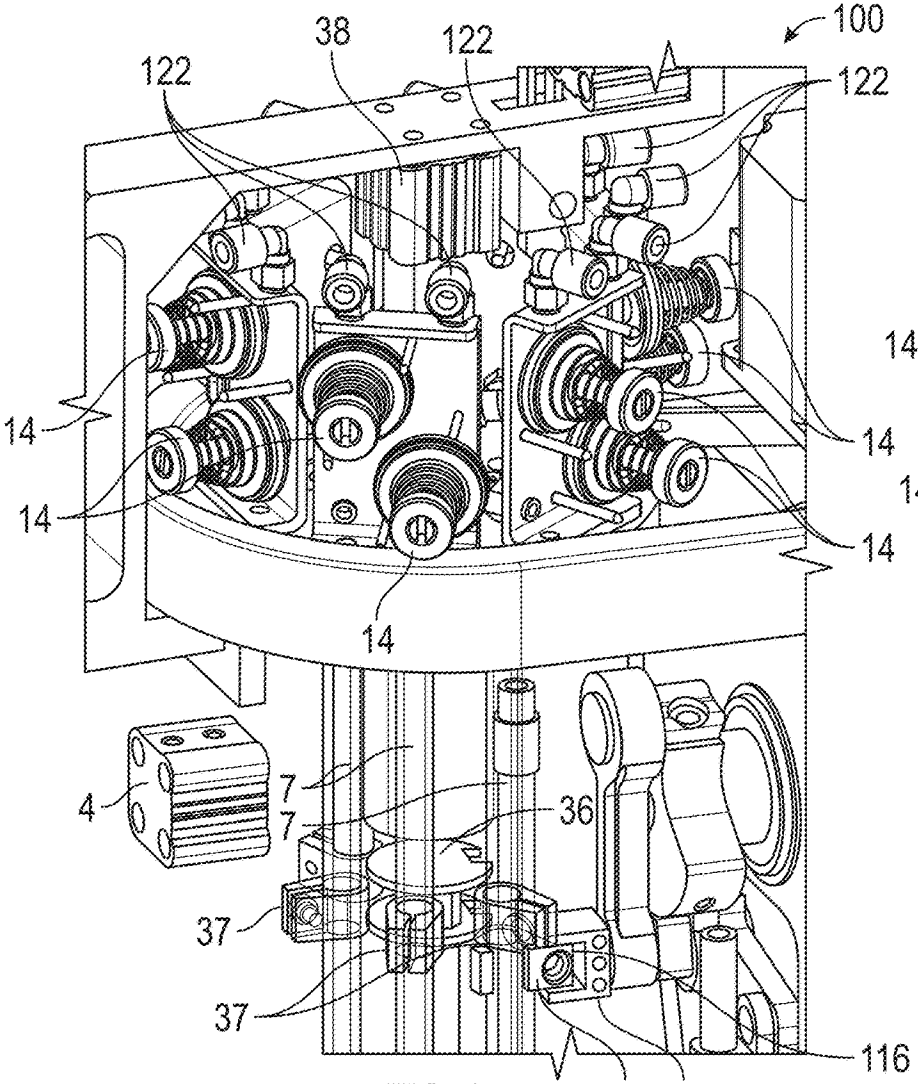
Figure 27:
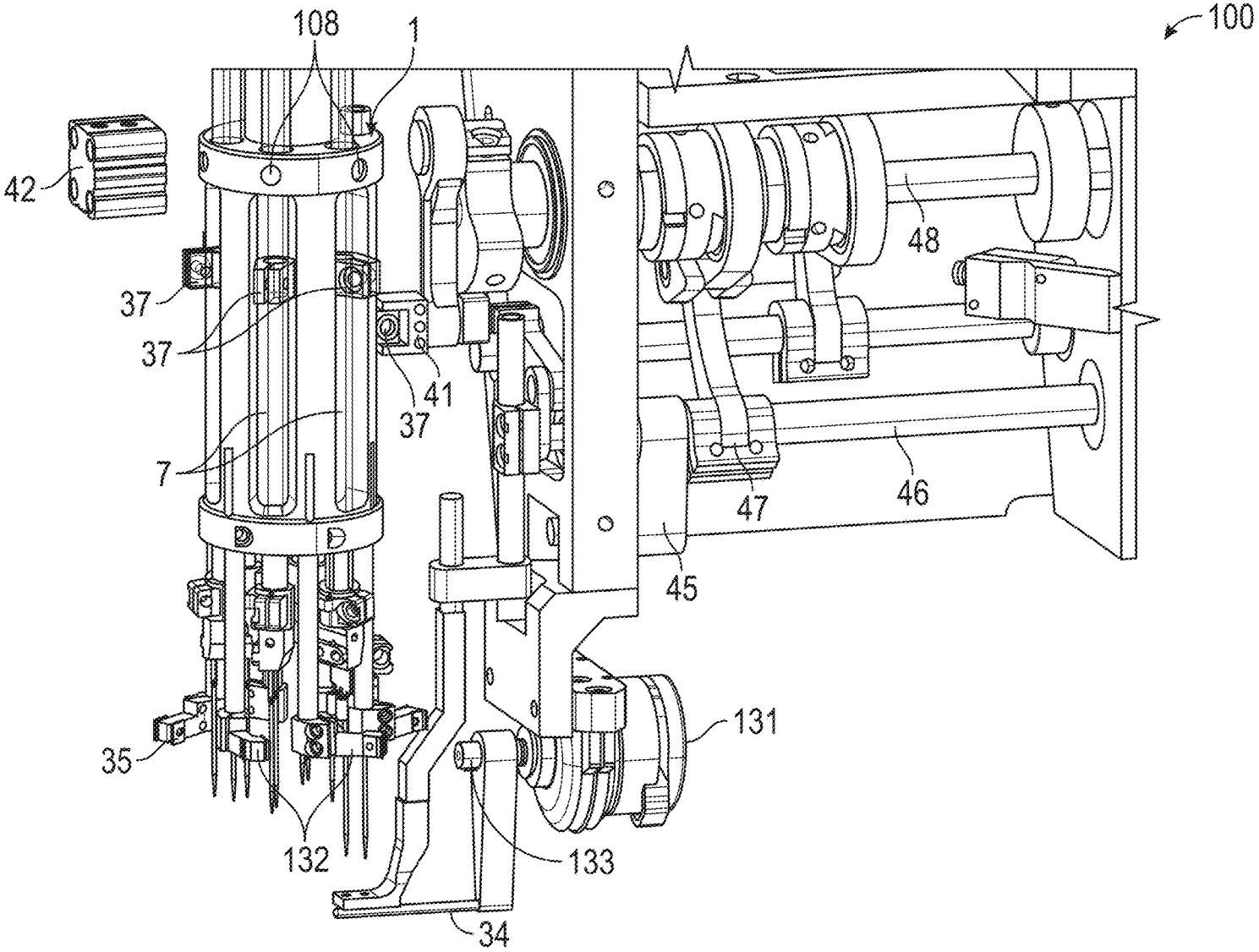
FIG. 27 is a perspective view of a portion of a sewing head in accordance with an embodiment of the present disclosure.
Figure 28:
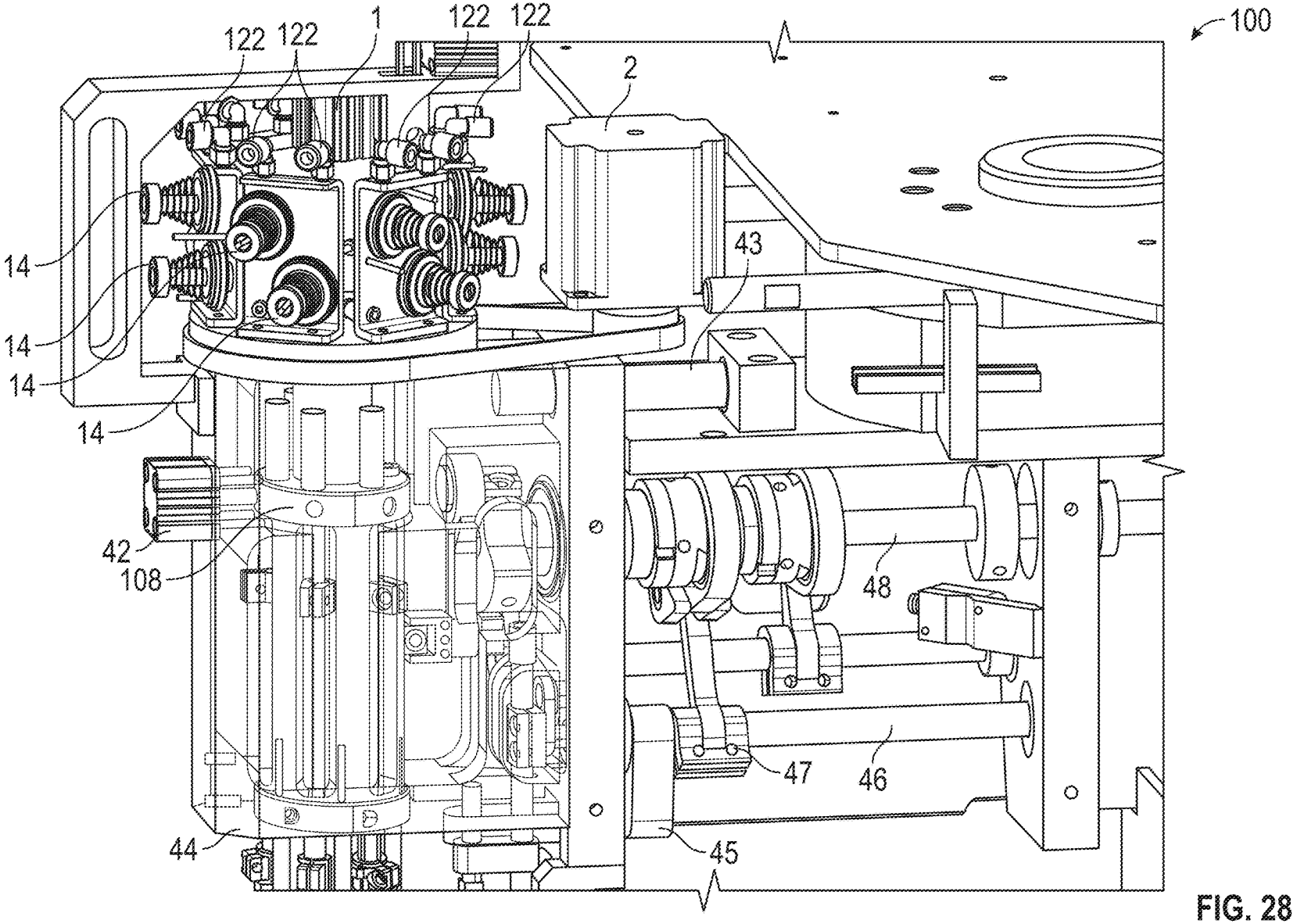
FIG. 28 is a perspective view of a portion of a sewing head in accordance with an embodiment of the present disclosure.

In one concept, a revolver type needle bar holder or revolver needle bar holder or revolver 1 is utilized which can hold up to six separate needle bars 7 (see at least FIG. 1). The revolver 1 is rotated by a motor 2 mounted to a side of a head, sewing head or robotic sewing head 100 via a belt 102. The revolver is supported by a series of four bearing spools 3, located on an upper support bracket 104. Once a desired needle bar 7 has been rotated into position, a pneumatic cylinder or electric solenoid 4 is engaged to lock the revolver 1 in place. This ensures revolver alignment and stability is maintained during sewing. This engagement is also illustrated in FIGS. 23 and 24, wherein the pneumatic cylinder or electric solenoid 4 extends a piston 106 that engages one of a plurality of recesses 108 located on the revolver 1.

Figure 2:
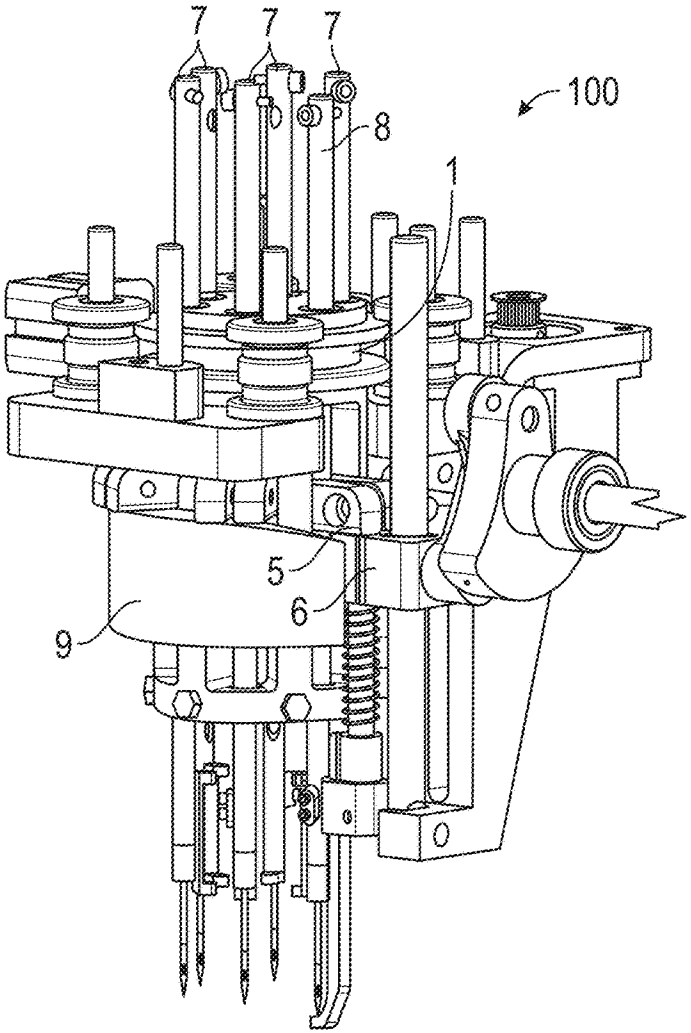
FIG. 2 is a perspective view of a revolver type needle bar holder according to the present disclosure that can hold up to six separate needle bars.
Figure 10:
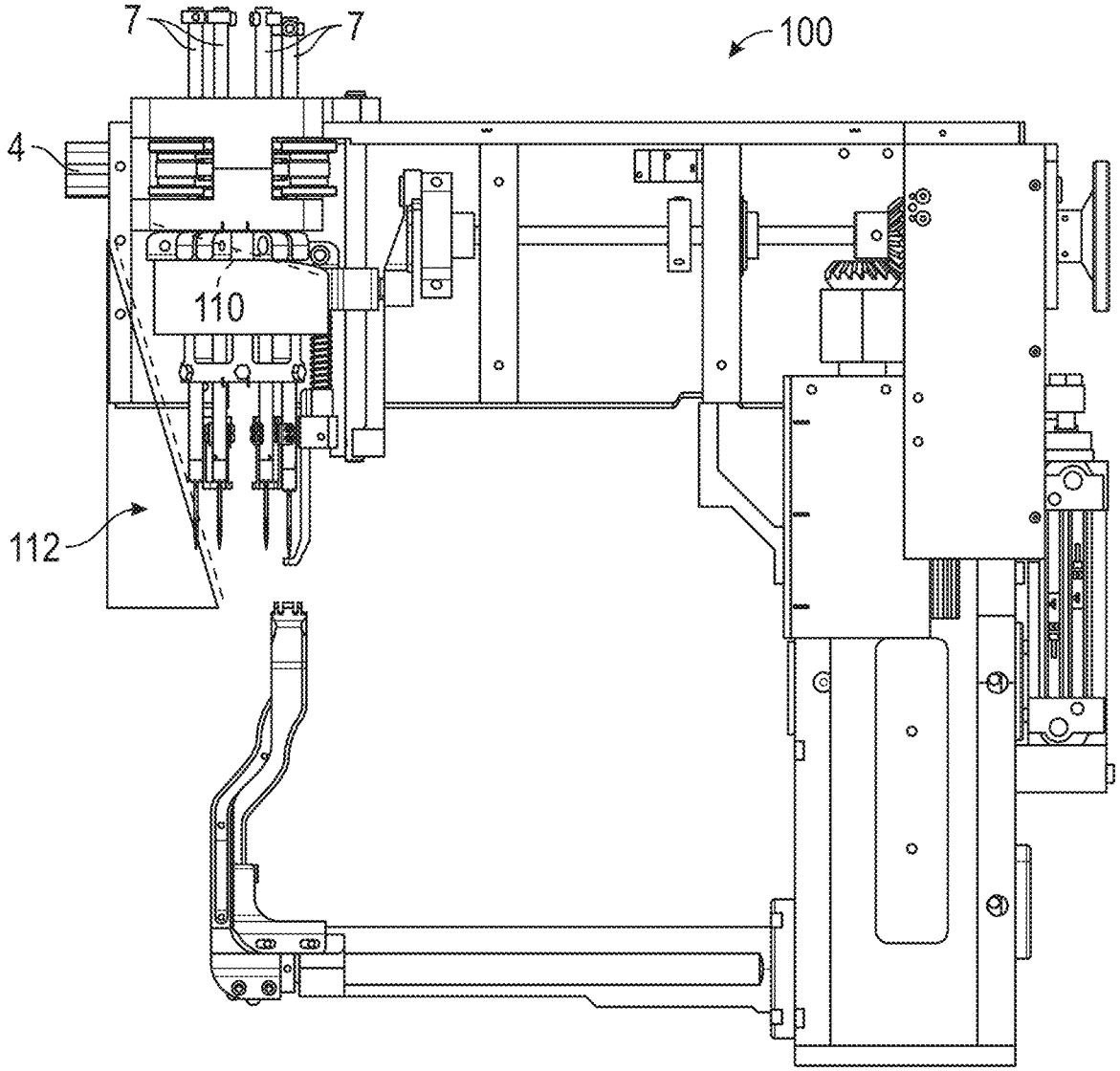
FIG. 10 illustrates how additional clearance can be achieved with the needle bar revolver.

As shown in FIG. 2, a needle bar clamp 5 engages a lift bracket 6 via mechanical interlock to ensure proper needle bar stroke and positioning is maintained from TDC (top-dead-center) to BDC (bottom-dead-center) of the stitching cycle at all sewing speeds. Note that the needle bars 7 not in use are positioned above the TDC of an active needle bar identified by reference numeral 8 to provide additional clearance between the inactive needle bars and the part surface. This is achieved via a cam plate 9 on which all the needle bars travel during needle bar change. This plate 9 can be further profiled such that the needle bars 7 closest to the end of the sewing head are positioned higher above a part surface to further minimize the potential for interference with the part being sewn or a part fixture during sewing. This is illustrated by the dashed line 110 in FIG. 10 where an area 112 is cleared to make additional room for a part to be sewn such that the needle bars 7 closest to the end of the sewing head 100 are positioned higher above the part surface to further minimize the potential for interference with the part or part fixture during sewing. As illustrated in at least FIG. 10, the increased lift from right to left (with respect to the view in FIG. 10) raises the needles closest to the end of the head 100. The cam plate 9 also serves as a lower guide for the revolver assembly 1.

Figure 19:
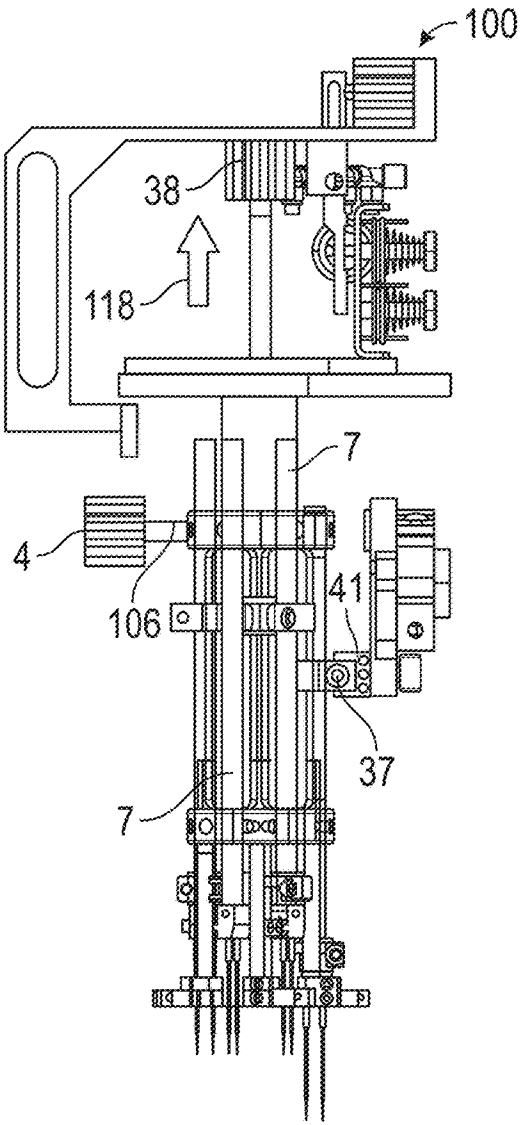
FIGS. 18-19 illustrate operation of a needle bar lift plate in accordance with an embodiment of the present disclosure.
Figure 18A:
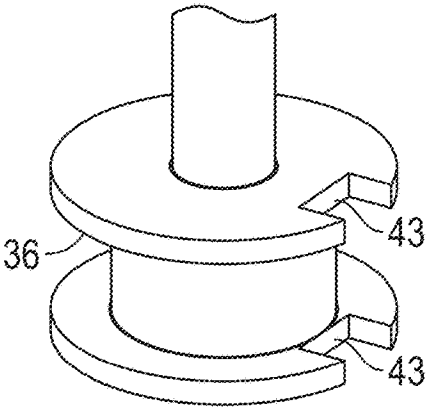
FIG. 18A is a perspective view of the lifting plate illustrated in FIGS. 18 and 19.
Figure 18:
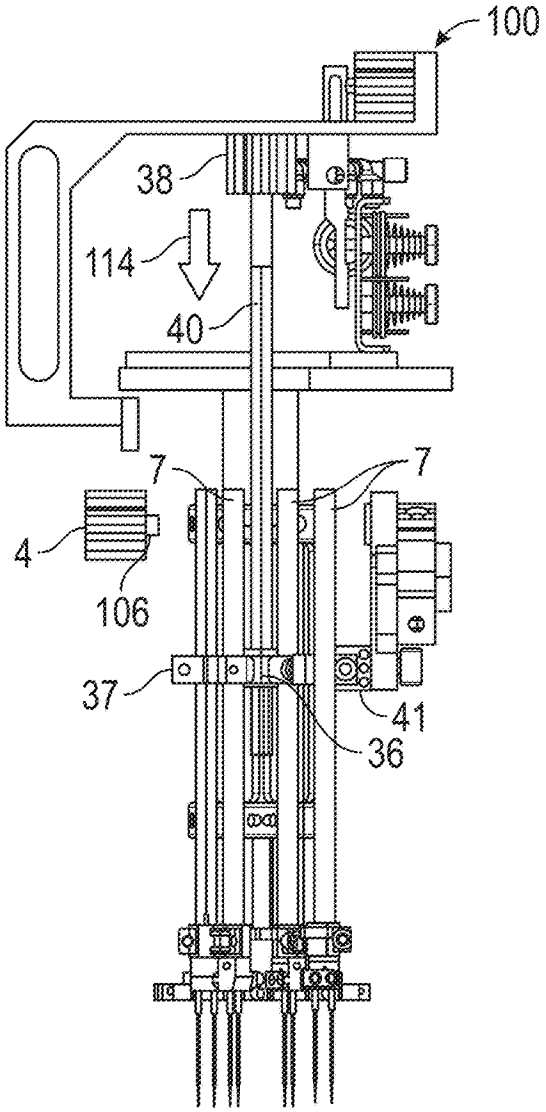

Alternatively and referring now to at least FIGS. 18 and 19, needle bar repositioning can be accomplished by using a pneumatically actuated lifting plate 36 in lieu of the cam plate. The lifting plate 36 is configured to engage a series of needle bar clamps 37 connected to each needle bar 7. To change needle bars, a pneumatic lift cylinder 38 extends in the direction of arrow 114, pushing the lifting plate 36 downward via a connecting rod 40. The connecting rod 40 being secured to the lifting plate 36 at one end and the pneumatic lift cylinder 38 at an opposite end. At full stroke, all of the needle bar clamps 37 are aligned with an upper shaft connecting rod clevis 41, which has an opening 116 configured to align with one of the needle bar clamps 37 of one of the needle bars 7. The motor 2 then rotates needle bar revolver 1 to align the desired needle bar with the connecting rod clevis 41. The lifting plate 36 remains stationary while the revolver 1 is rotated. Upon alignment, the revolver lock cylinder 4 extends, locking the needle bar revolver 1 in position. The pneumatic lift cylinder 38 then retracts in the direction of arrow 118, lifting all needle bars 7 engaged with the lifting plate except for the desired needle bar 7 that has been aligned with the opening 116 of the connecting rod clevis 41. Clearance slots 43 are provided in the lifting plate 36 which allow the selected needle bar 7 engaged with the connecting rod clevis 41 to remain in place or in other words, the selected needle bar does not move in the direction of arrow 118 as it can slide in the clearance slots 43. The needle bar 7 engaged with the connecting rod clevis 41 is utilized for subsequent sewing.

Figure 20:
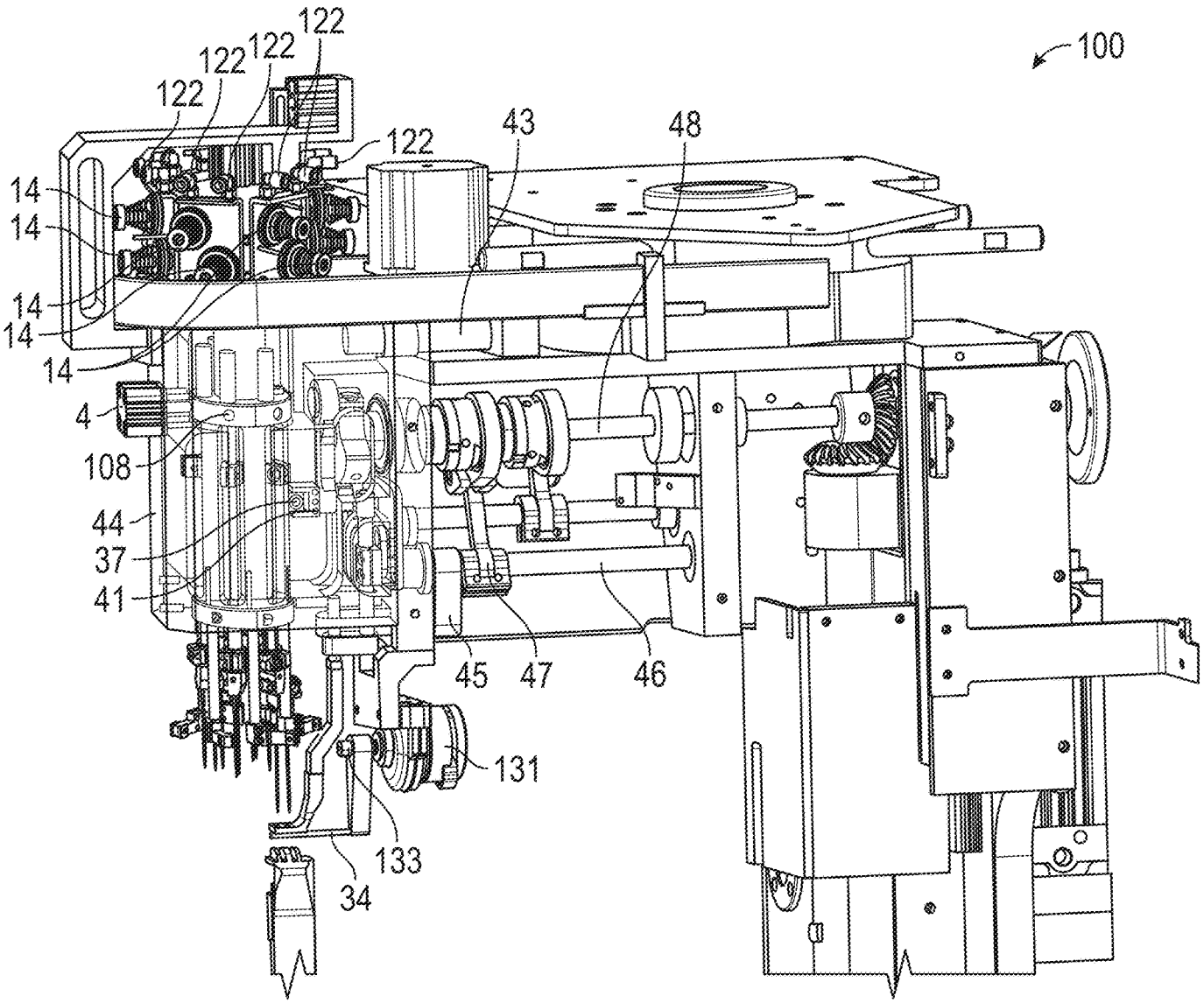
FIG. 20 is a perspective view of a sewing head in accordance with an embodiment of the present disclosure.
Figure 21:
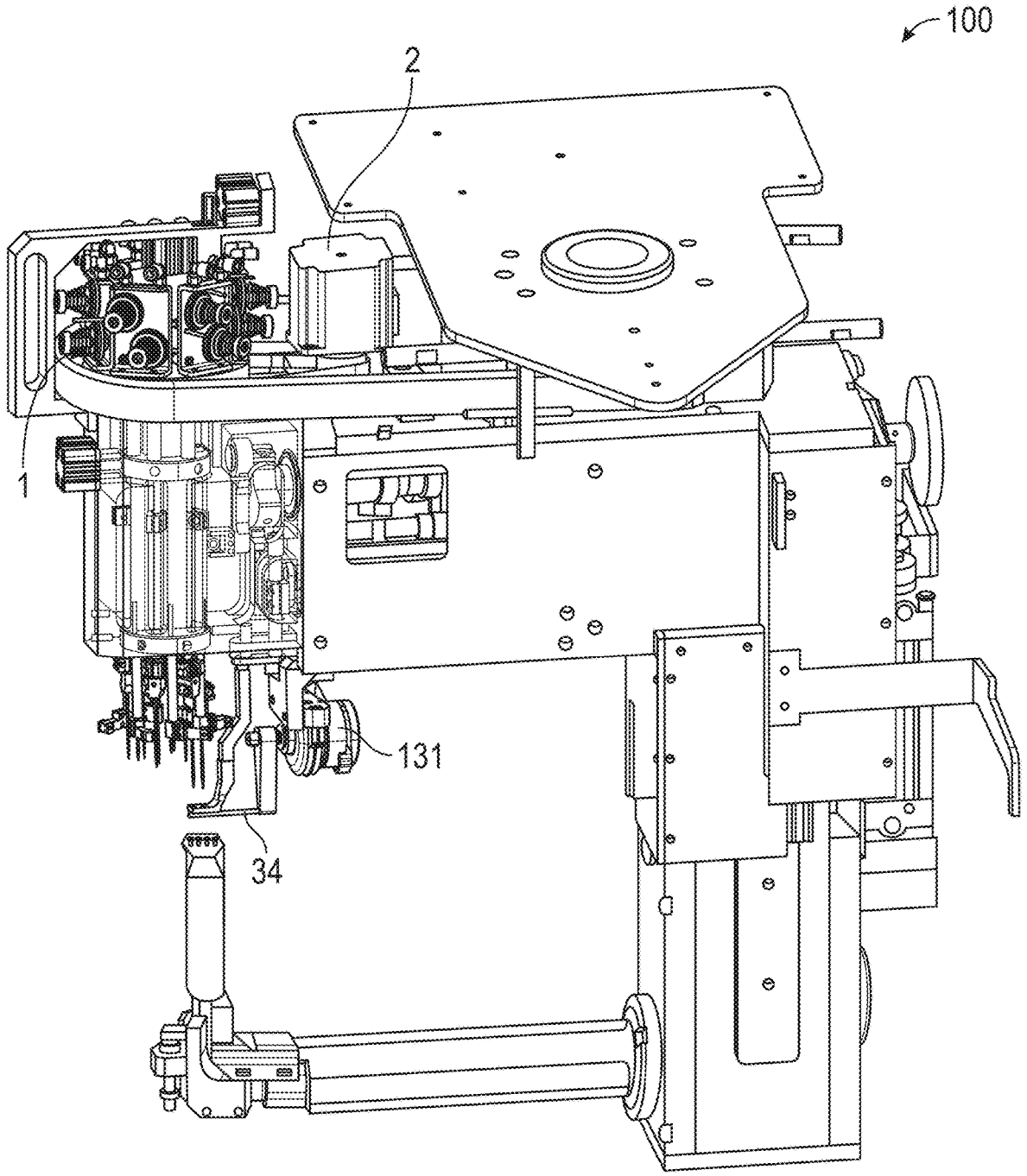
FIG. 21 is a perspective view of a sewing head in accordance with an embodiment of the present disclosure.
Figure 22:
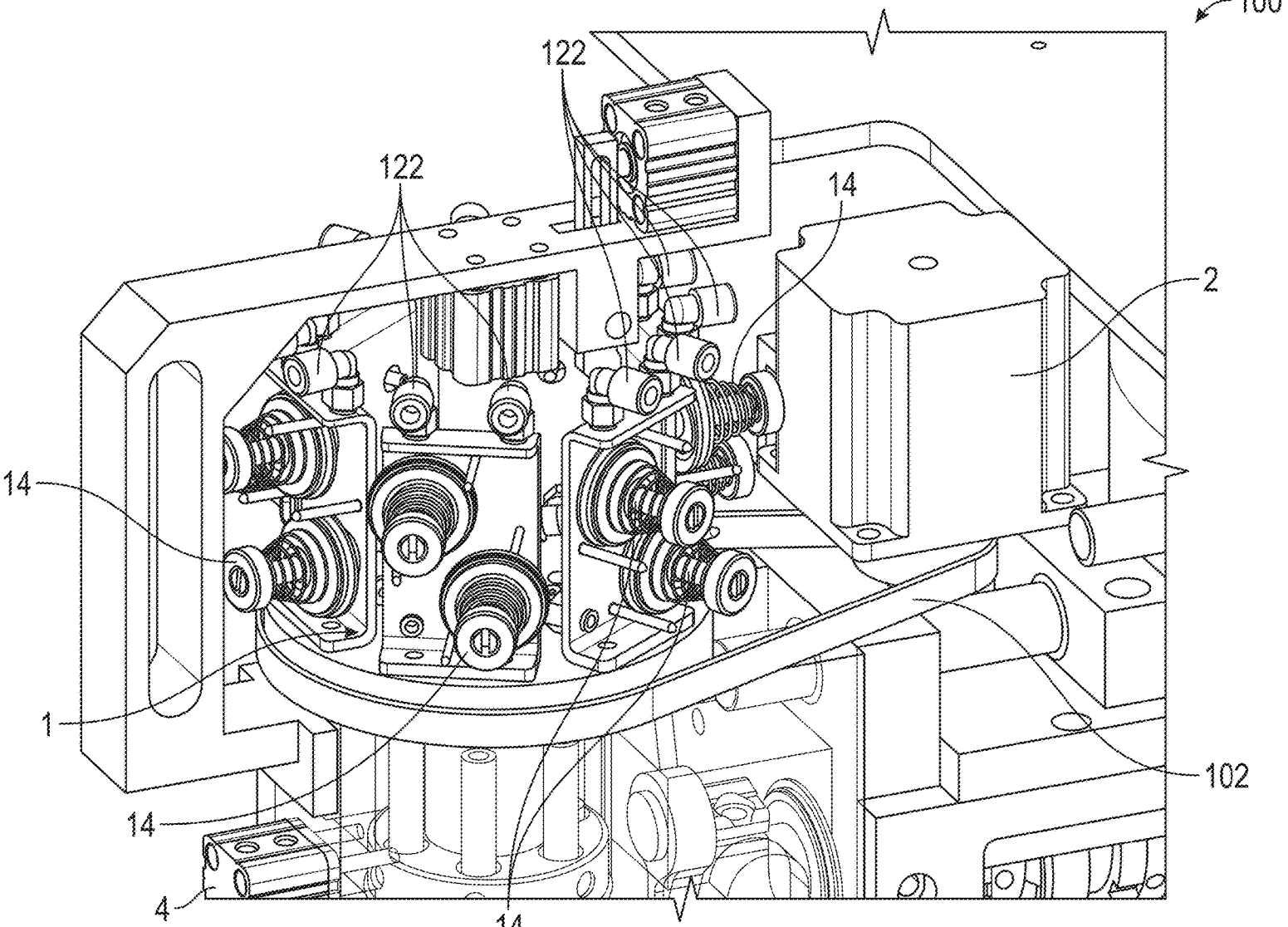
FIG. 22 is a perspective view of a portion of a sewing head in accordance with an embodiment of the present disclosure.

As shown in FIG. 20, a needle bar revolver assembly 44 include the revolver 1 is also capable of rotating to allow needle bar transport as required. The needle bar revolver assembly 44 pivots about an upper shaft 43. Rotation is driven by transport arm 45 that rotates with lower shaft 46. Lower shaft rotation is generated via an eccentric assembly 47 which is mounted to a main upper drive shaft 48 of the head 100. As the main upper drive shaft 48 rotates, the eccentric assembly 47 produces an oscillatory motion that is transmitted to the lower shaft 46 and yields the subsequent fore and aft rotary motion of the transport arm 45 in sequence with the stitch cycle. The eccentric assembly 47 can be adjusted to vary the degree of needle bar revolver assembly 44 rotation as desired.

Figure 3:
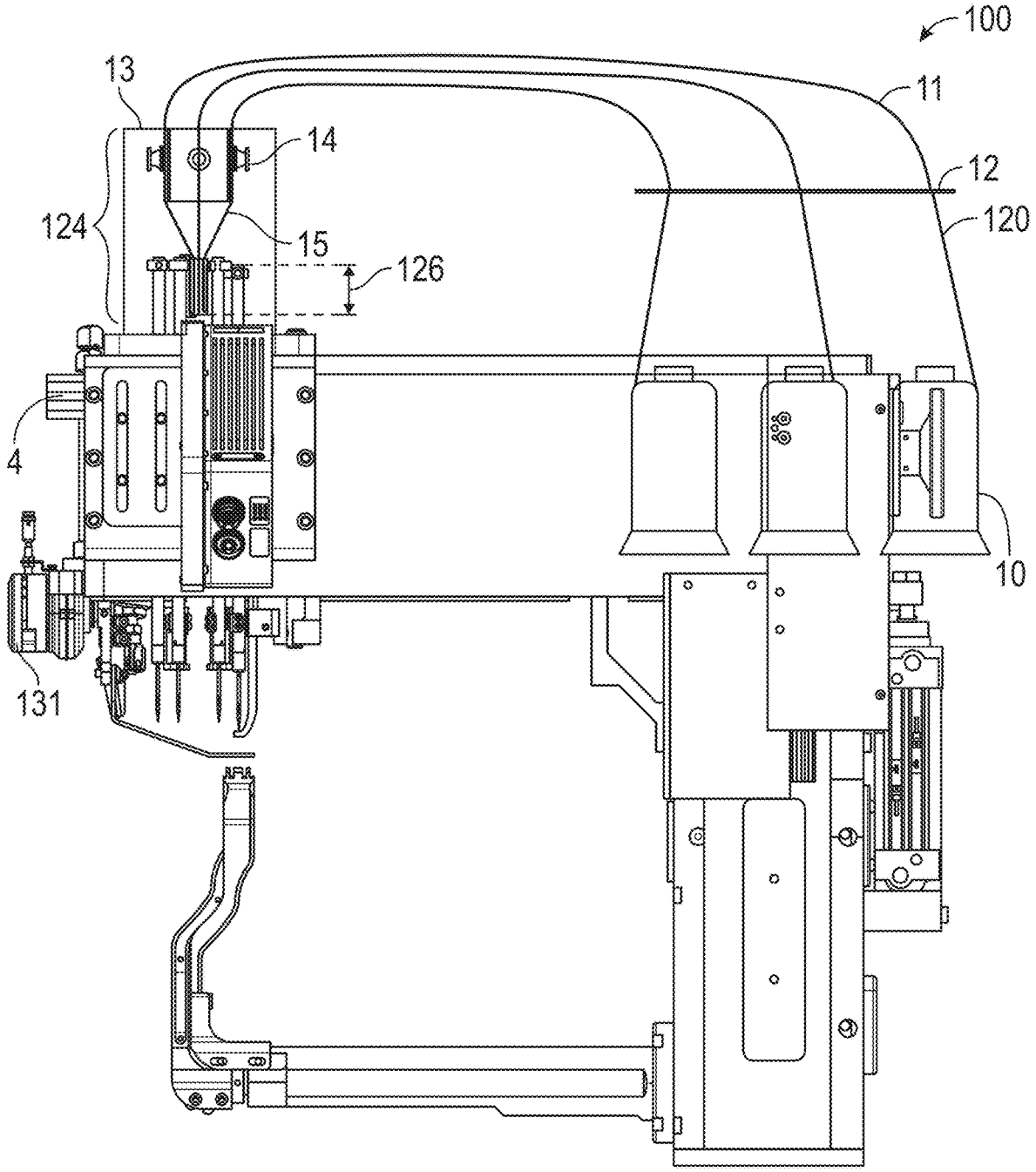
FIG. 3 shows an upper thread being fed from individual spools through a series of guides and tensioners prior to entering the top end of the hollow needle bar in accordance with the present disclosure.

As shown in FIG. 3, an upper or top thread 120 is fed from individual spools 10 through a series of guides 122 and tensioners 14 prior to entering the top end of the hollow needle bar. In other words, each one of the needle bars are hollow. See also FIGS. 22-26, 28 and 30. Each needle bar itself serves as thread take up arm, creating thread slack to allow capture by the looper or hook during stitch creation. Thread fed from the spools is routed through tubing 11 that runs from a spool mount guide bracket 12 to a top plate 13 of the revolver assembly 44. The thread is then routed to individual thread tensioners 14 located below the top plate of the revolver assembly. Once the thread passes through the tensioner 14, it is routed through an additional guide manifold 15 with the thread exit point located below the top dead center (TDC) of the needle bar 7. The guide manifold 15 is adjustable to provide the ability regulate the amount of top thread 120 available at the needle to create the stitch. The top plate, thread tensioners and guide assembly are mounted to and rotate with the revolver 1 of the revolver assembly 44 to eliminate thread entanglement and ensure consistent tension from color to color. These components are illustrated by bracket 124 in FIG. 3. Also, shown is a thread take-up adjustment denoted by arrows 126.

Figure 4:
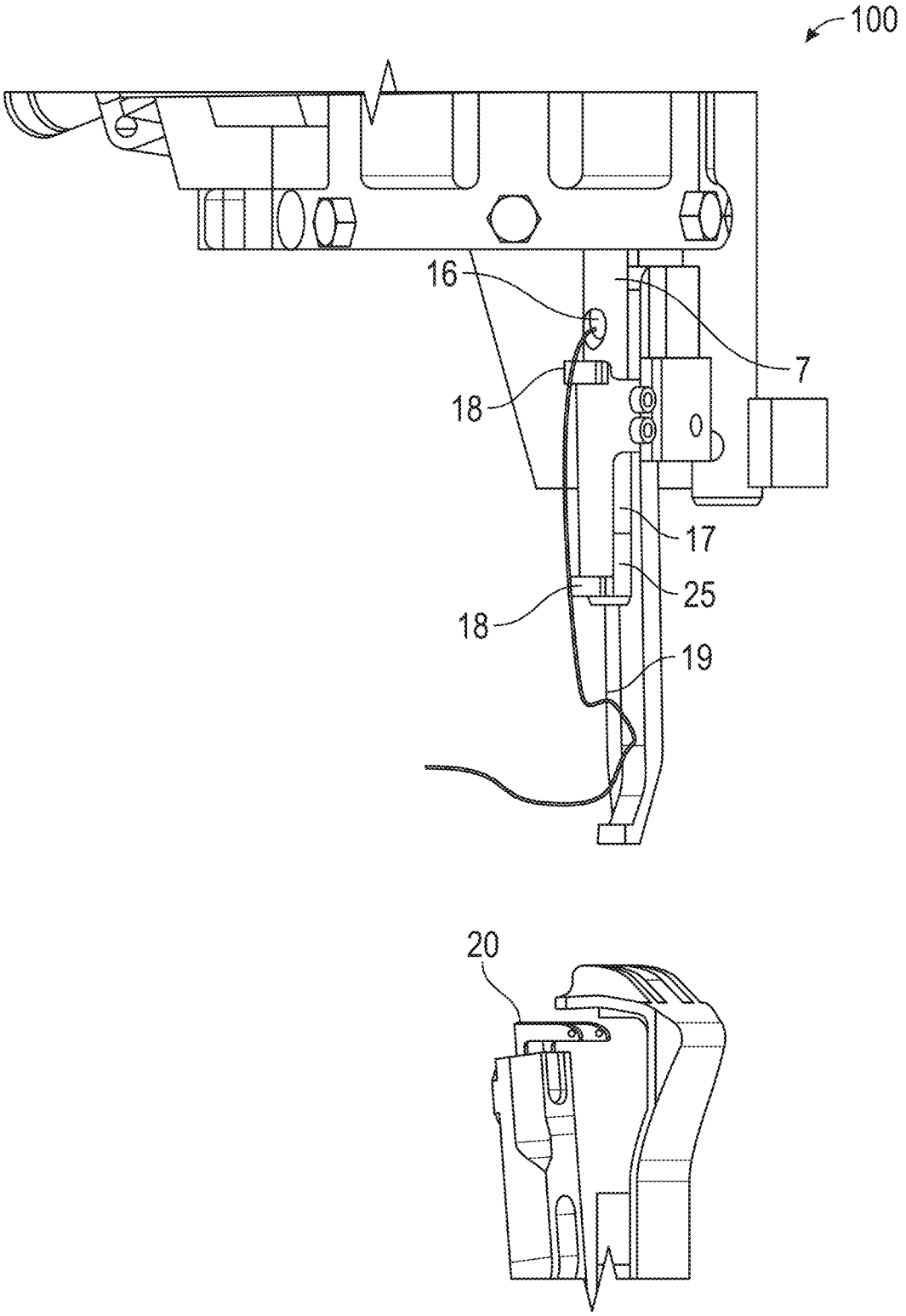
FIG. 4 illustrates the lower end of the needle bar revolver in accordance with the present disclosure.

FIG. 4 illustrates thread exiting the needle bar outlet 16 just above the needle holder 17. The thread is routed through one or more guides 18 before passing through the eye of the needle 19. The guides 18 can be designed to provide adjustable tension to the thread as necessary to minimize thread movement resulting in improved stitch formation occurring between the needle 19 and looper or hook 20. FIG. 4 illustrates a single needle configuration. In the case of a double needle configuration, two threads would be fed through the center of the needle bar from top to bottom, pass through the same guides before threading the eye of the needles located in a double needle holder inserted at the bottom of the needle bar.

Figure 5B:
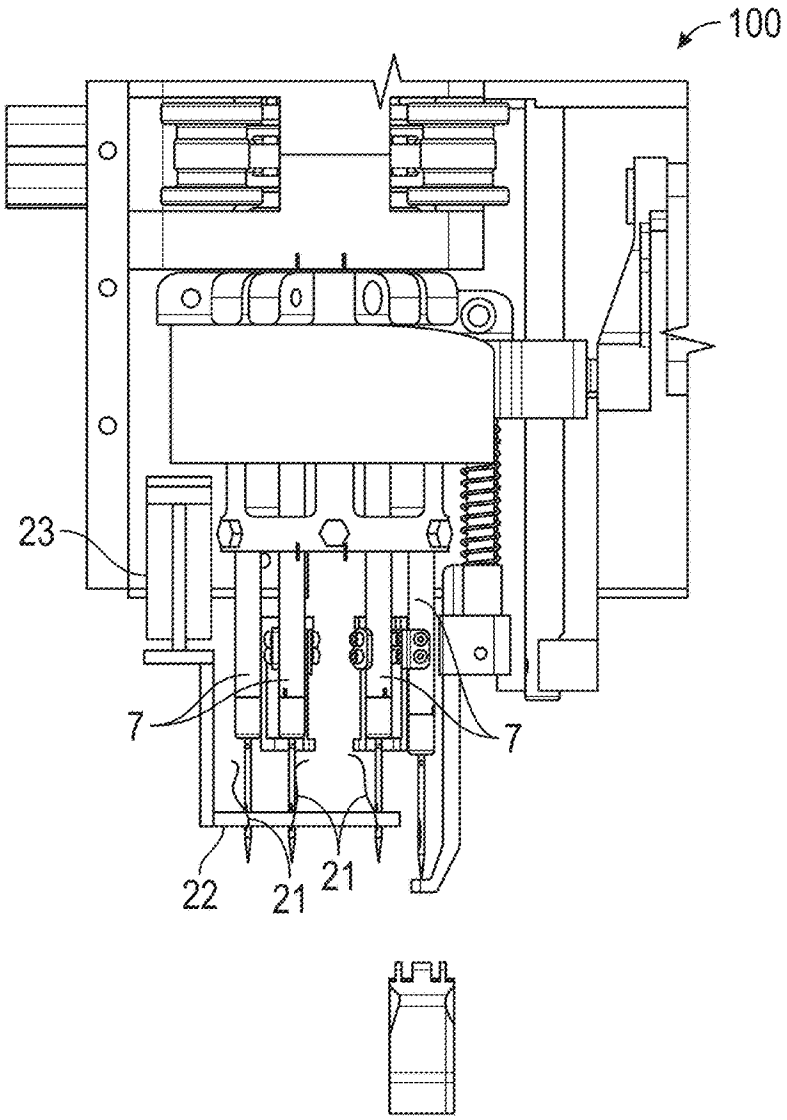
FIG. 5B illustrates the plate position during sewing in accordance with the present disclosure.
Figure 5A:
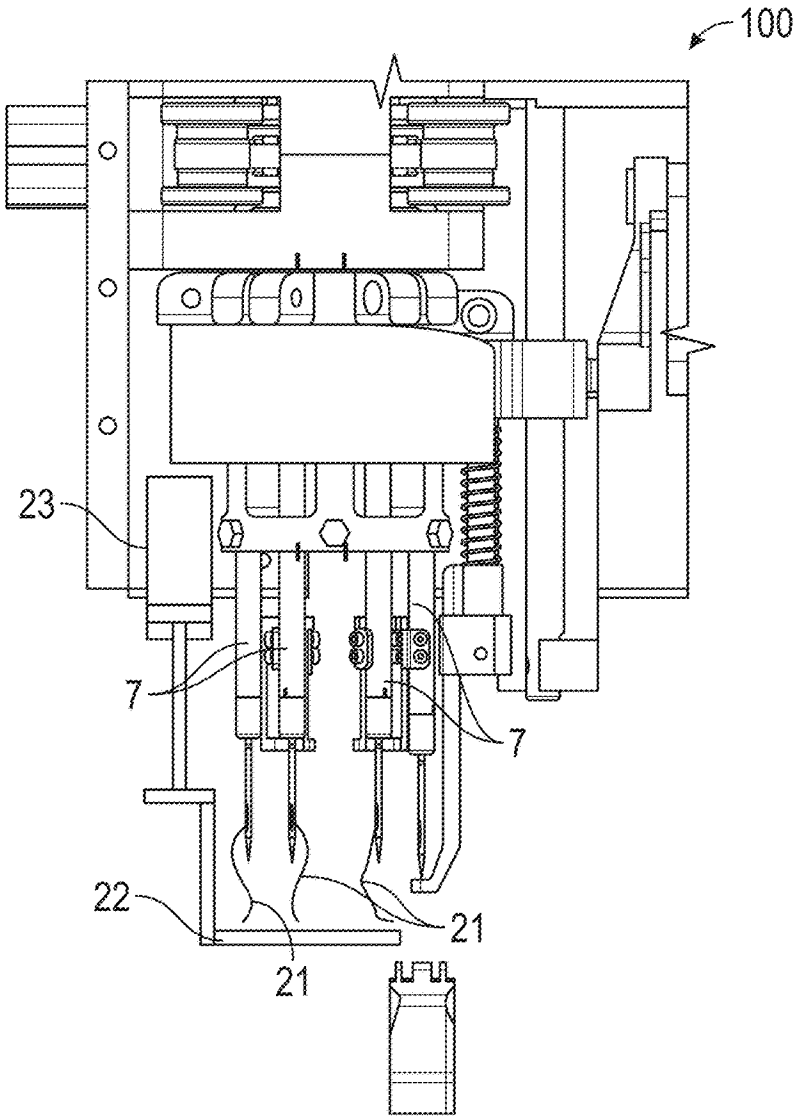
FIG. 5A illustrates the plate position during the needle bar rotation in accordance with the present disclosure.

FIGS. 5A and 5B illustrates one way of securing and relocating loose thread tails 21 to prevent interference with part feature scanning that occurs during sewing. A plate 22, driven by a pneumatic or electric actuator 23, surrounds the needles and moves axially along the length of the needle from a certain distance below the needle tip to a certain distance above the tip of the needle. When the plate 22 is in its lowest position, the needle bar revolver 1 is free to rotate to allow color changes. Once the desired needle bar 7 is in position, the plate 22 is raised to its upper position, trapping the loose thread tails of all unused needle bars by carrying them upward and holding them in place during sewing.

Figure 6C:
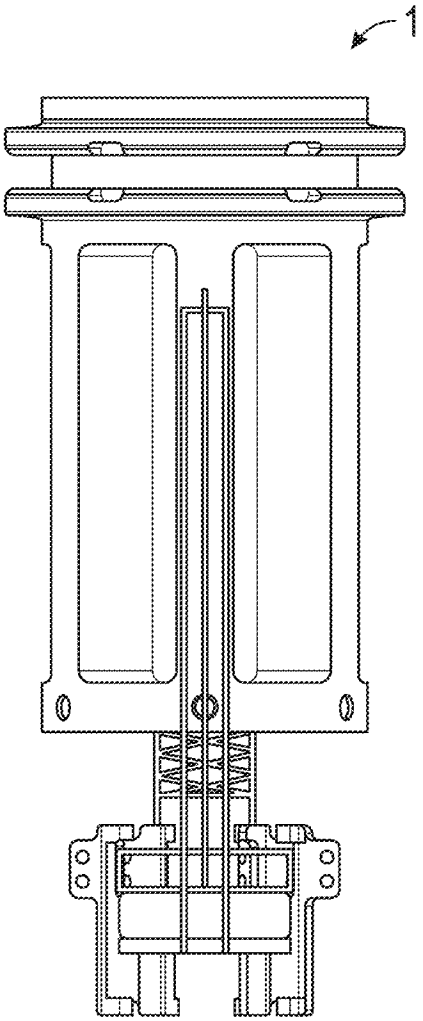
FIGS. 6A-6C illustrates an alternative means of securing and relocating loose thread tails via the use of a thread brake in accordance with the present disclosure.
Figure 6B:
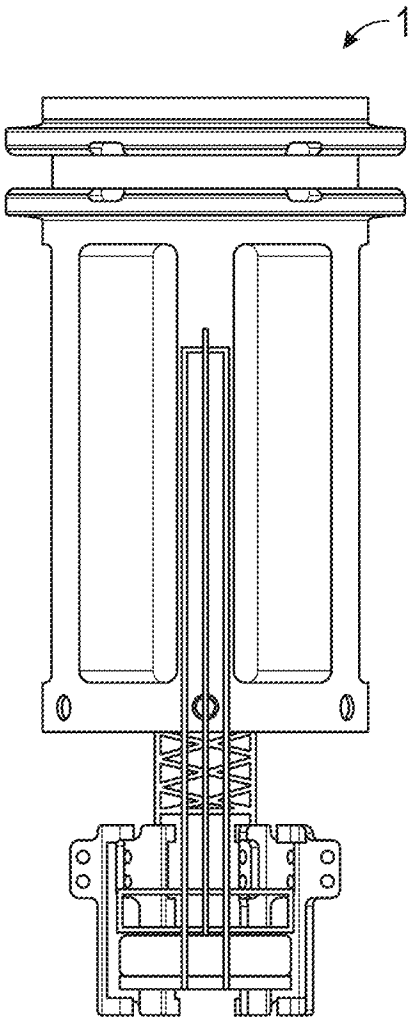
Figure 6A:
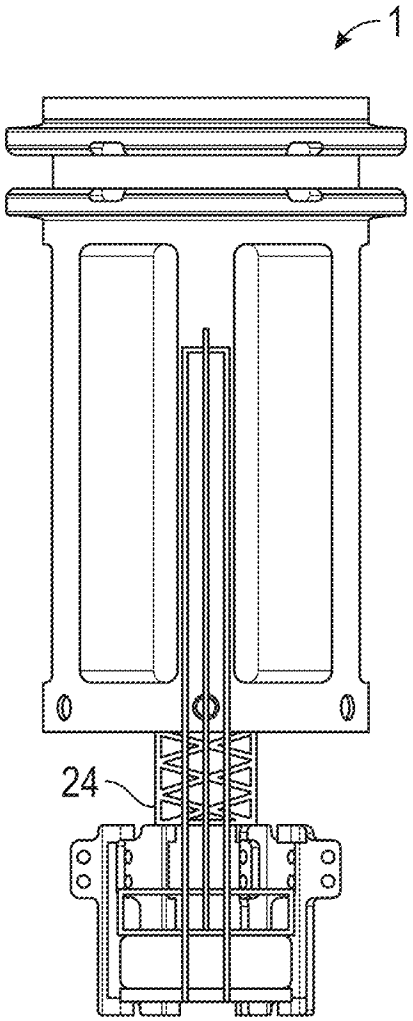
Figure 7:
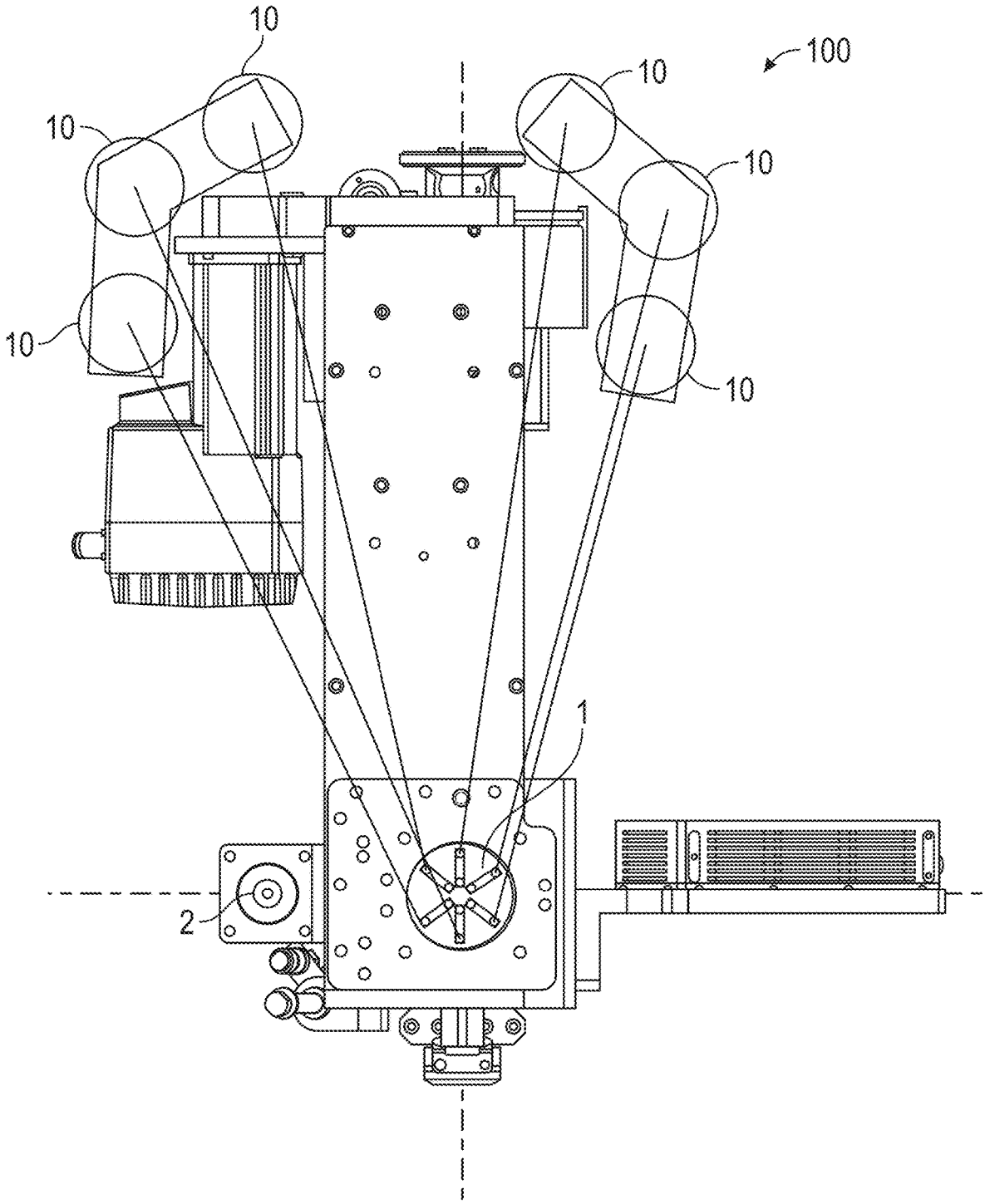
FIG. 7 illustrates the upper thread feed in accordance with the present disclosure.
Figure 8:
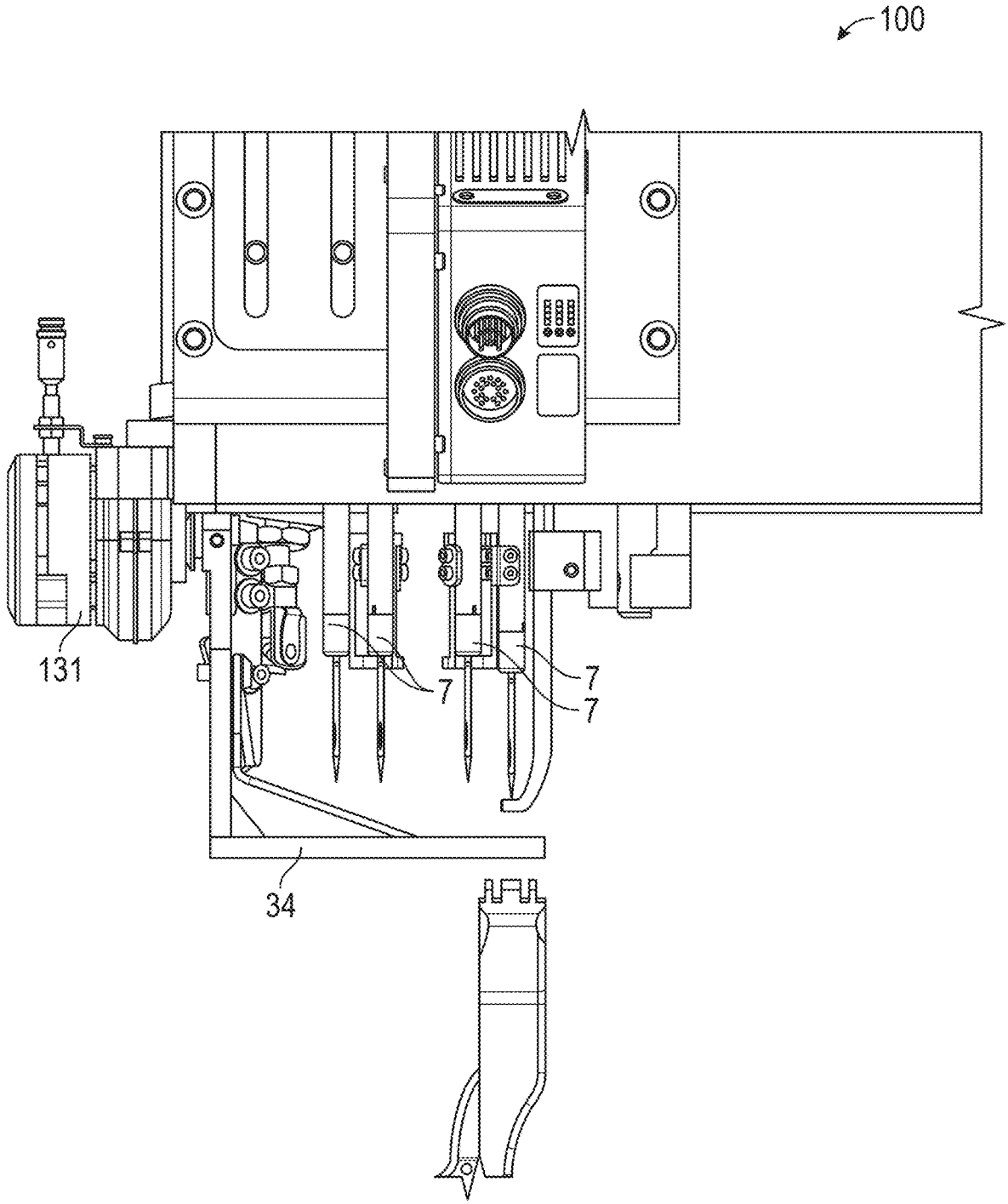
FIG. 8 illustrates the swiper arm in accordance with the present disclosure.
Figure 9:
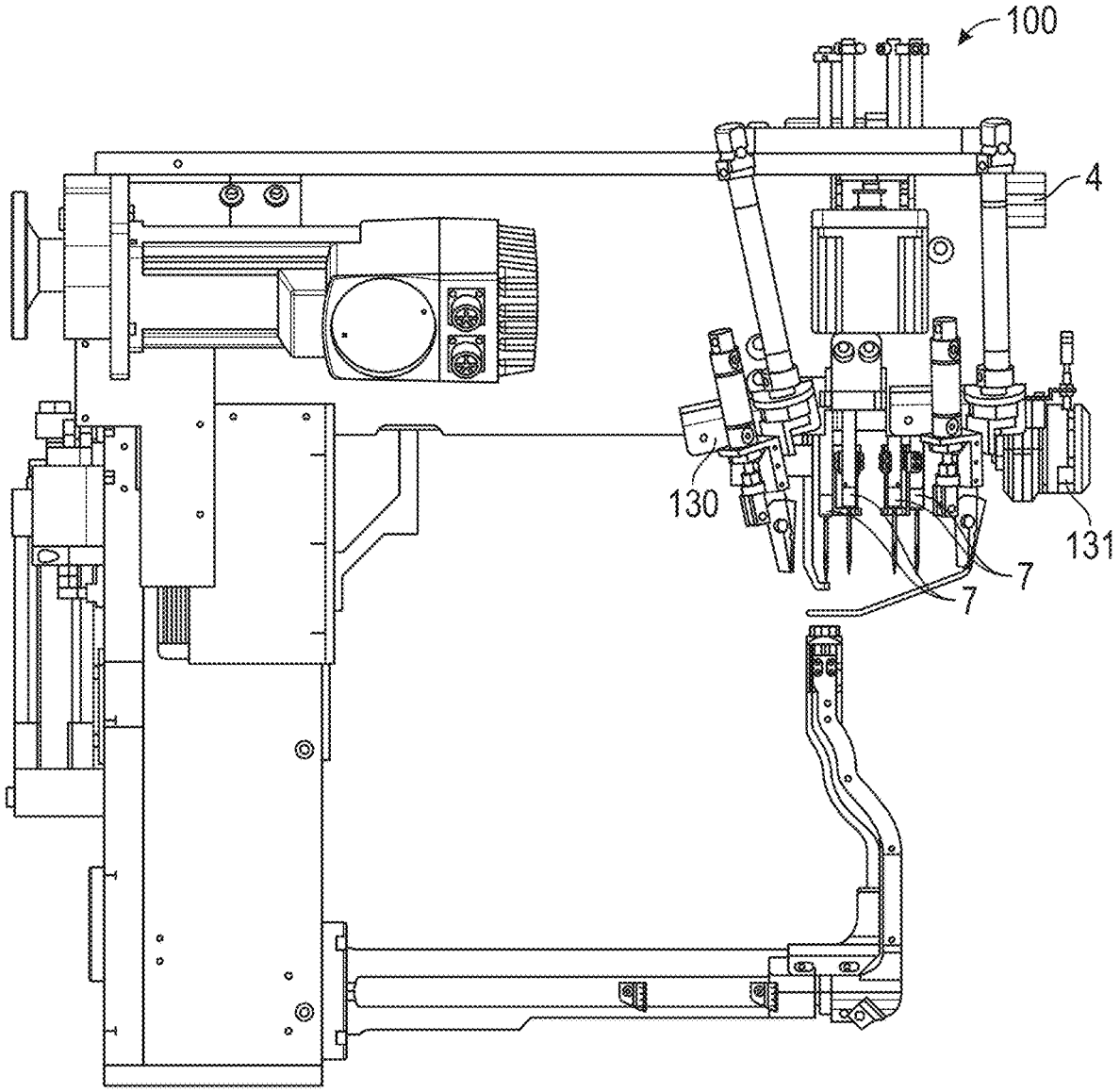
FIG. 9 illustrates the scissor assembly in accordance with the present disclosure.

FIGS. 6A-6C illustrates an alternative means of securing and relocating the loose thread tails via the use of a thread brake 24 which can be employed to both retract and lock thread present in the auxiliary needle bars and prevent thread tails from interfering with the sewing or part scanning process. The brake is notched such that the needle bar in use does not engage with the brake. FIG. 6A shows the thread brake 24 disengaged while FIG. 6B shows the thread brake engaged and the FIG. 6C shows the thread brake engaged and the thread retracted.

FIGS. 13-17 illustrate yet another alternative means of securing the loosed thread tails protruding from the idle needle bars 7. After the last stitch the head 100 stops sewing and before revolver actuation or rotation, a swiper arm 34 rotates clockwise (with respect to the FIGS. 13-17 or in the direction of arrow 127) from its home position to engage or capture the top thread which is connected between the needle and a last stitch of a part 128 being sewn. After engagement, the swiper arm 34 continues its clockwise rotation in the direction of arrow 127 to a point where the thread engages with a spring clip 35 which traps the thread. Once the thread is trapped, the swiper arm rotates counter-clockwise (with respect to the FIGS. 13-17 or in the direction of arrow 129) to a position that enables thread trimming with a scissor 130 to occur. Once trimmed the upper thread from the needle remains constrained by the spring retention clip 35 while the swiper arm 34 returns to the home position. The needle bar revolver 1 can now be rotated for subsequent thread color or needle quantity change.

Rotation of the swiper arm 34 is achieved through a swiper arm cylinder 131 that rotates a shaft 133 secured to the swiper arm 34.

Figure 13:
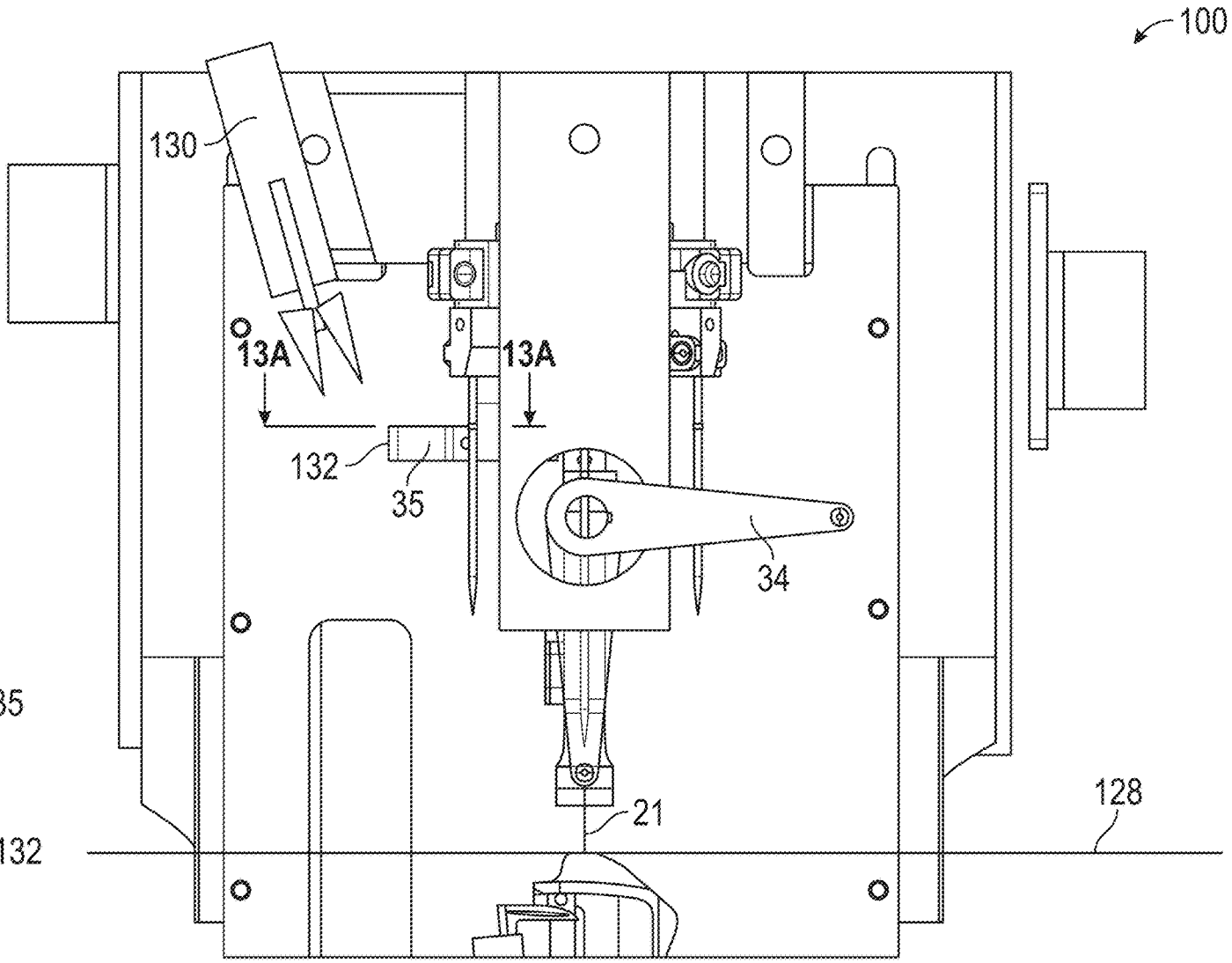
FIGS. 13-17 illustrate thread tail retention of the sewing head in accordance with an embodiment of the present disclosure.
Figure 13A:
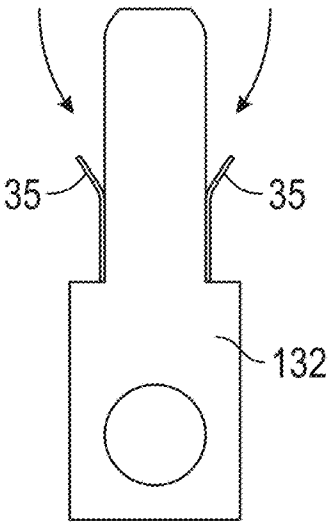
FIG. 13A is a view along lines 13A-13A of FIG. 13.
Figure 14:
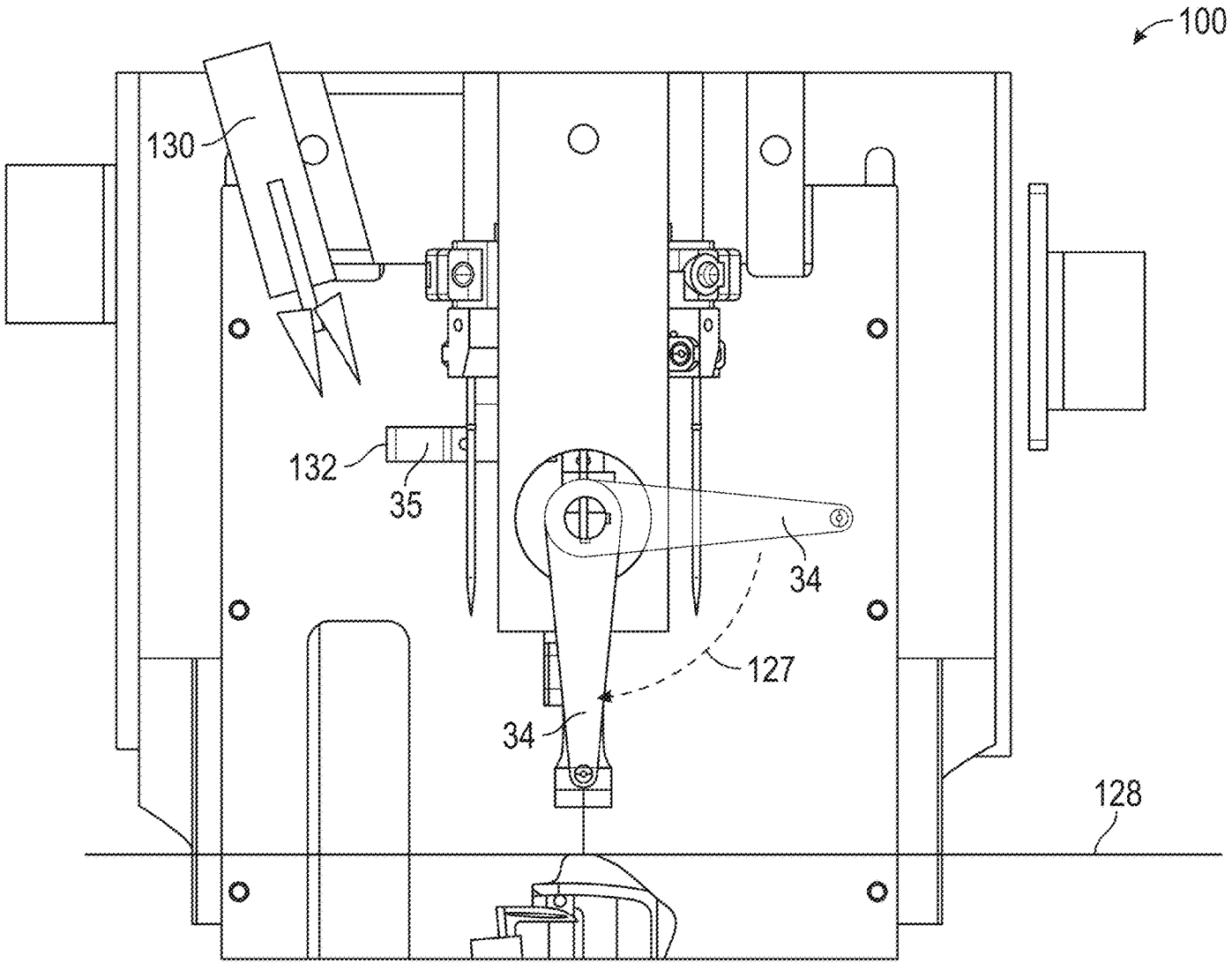
Figure 15:
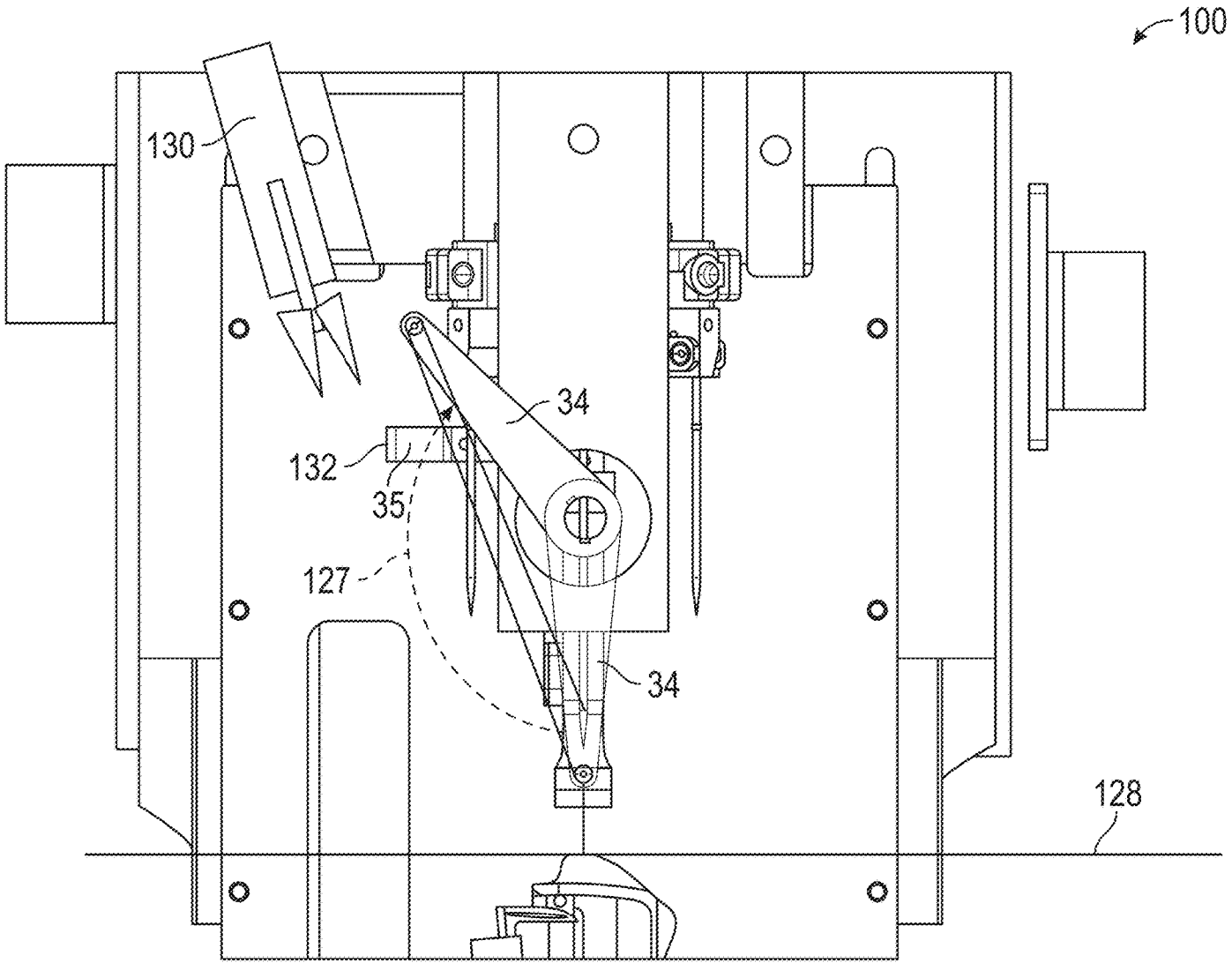
Figure 16:
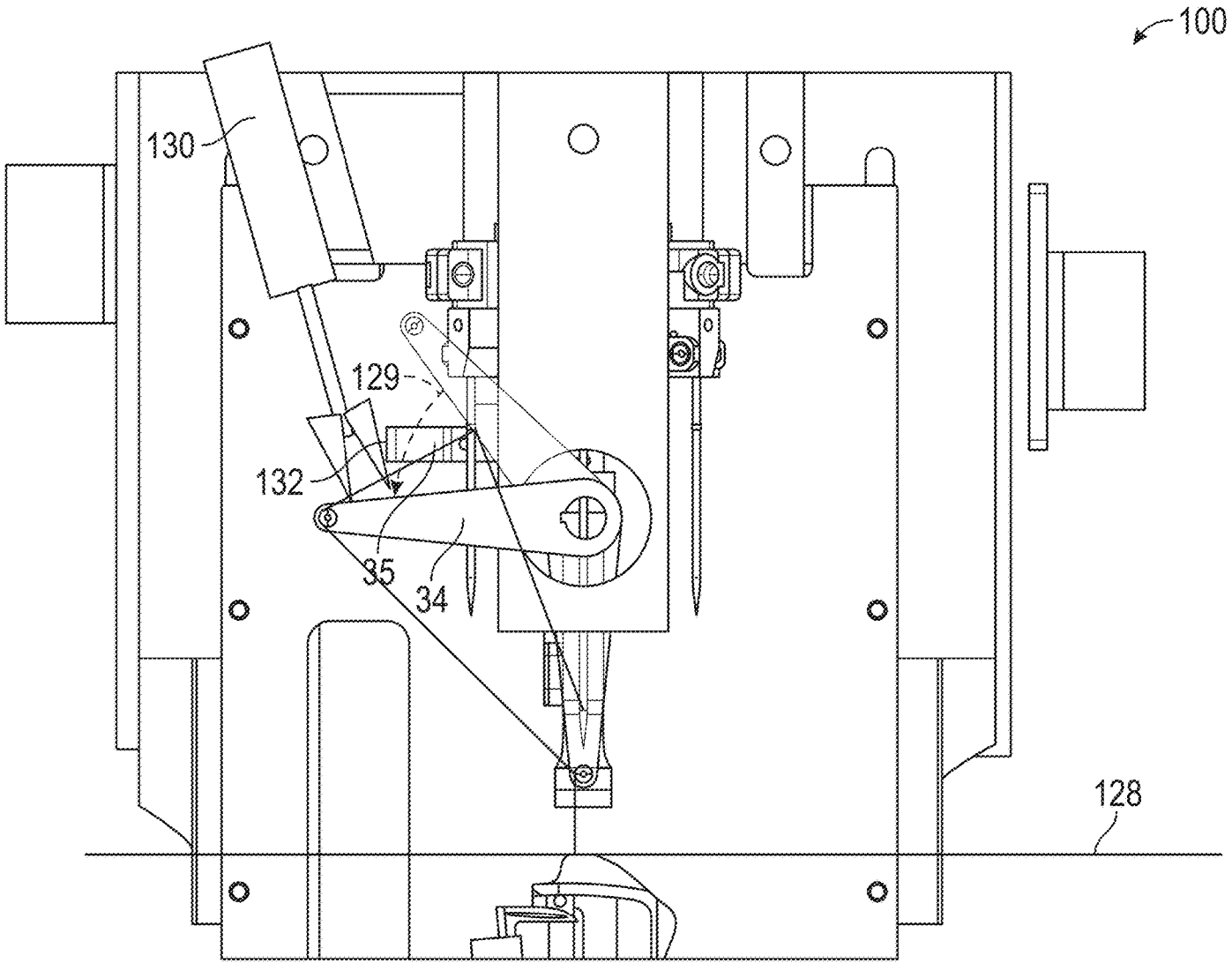
Figure 17:
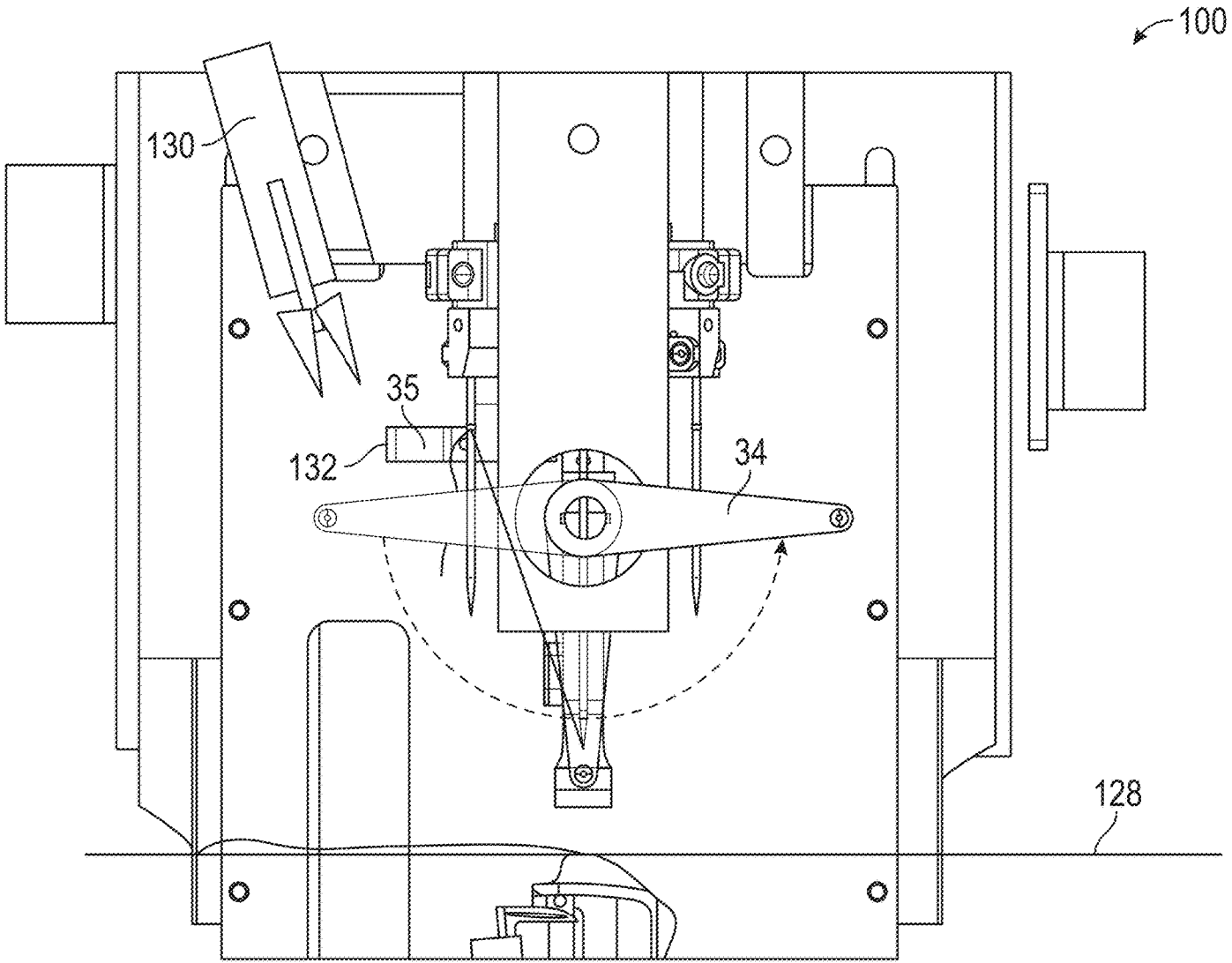
Figure 29:
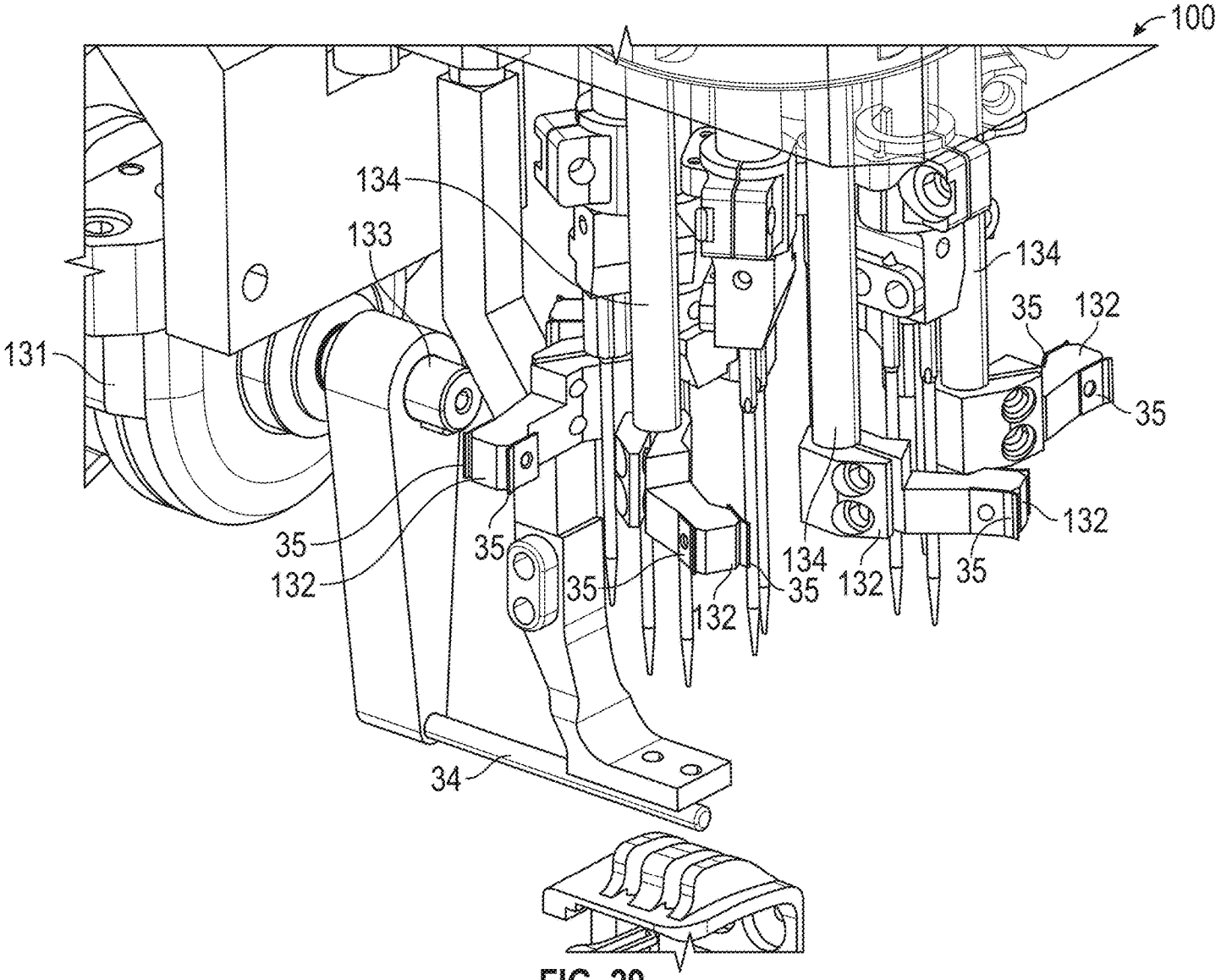
FIG. 29 is a perspective view of a portion of a sewing head in accordance with an embodiment of the present disclosure.

FIG. 13A is a view along lines 13A-13A of FIG. 13 which illustrates a spring clip arm 132 that has the spring retention clips 35 on either side. Each needle bar 7 of the needle bar assembly has an associated spring clip arm 132 that is separately secured to the revolver 1 of the needle bar revolver assembly 44 via a shaft 134 such that rotation of the revolver will rotate each spring clip arm 132. This is also illustrated in at least FIG. 29.

The concept discussed herein takes in account existing packaging requirements of components necessary for automatic thread repositioning, trimming, and scanning of a tracking feature position accomplished in real time. The concept also considers typical space requirements above and below the part surface that are encountered during automated 3D part sewing.

This concept can be used with either lockstitch or chainstitch type sewing.

In accordance with various non-limiting embodiments of the present disclosure, the revolver type needle bar holder 1 may be used with a robotic sewing head 100. Still further and in accordance with various non-limiting embodiments of the present disclosure, the revolver type needle bar holder may be used to applying stitching to components and in one non-limiting embodiment, the components may be interior trim components of a vehicle or automobile.

The revolver needle bar holder 1 can also be configured to manage a single needle clamp 25 at the end of each bar, a double needle clamp at the end of each bar, or a combination of one or more needle bars configured for single needle clamp while the remaining needle bars are configured for double needle clamp.

When the revolver needle bar holder is configured to manage a combination of both single and double needle bar clamps, the ability to sew both single and double needle decorative stitch patterns on the same part within the same process cycle without exchanging the sewing head or moving the part between multiple sewing cells or stations is now possible.

Figure 12:
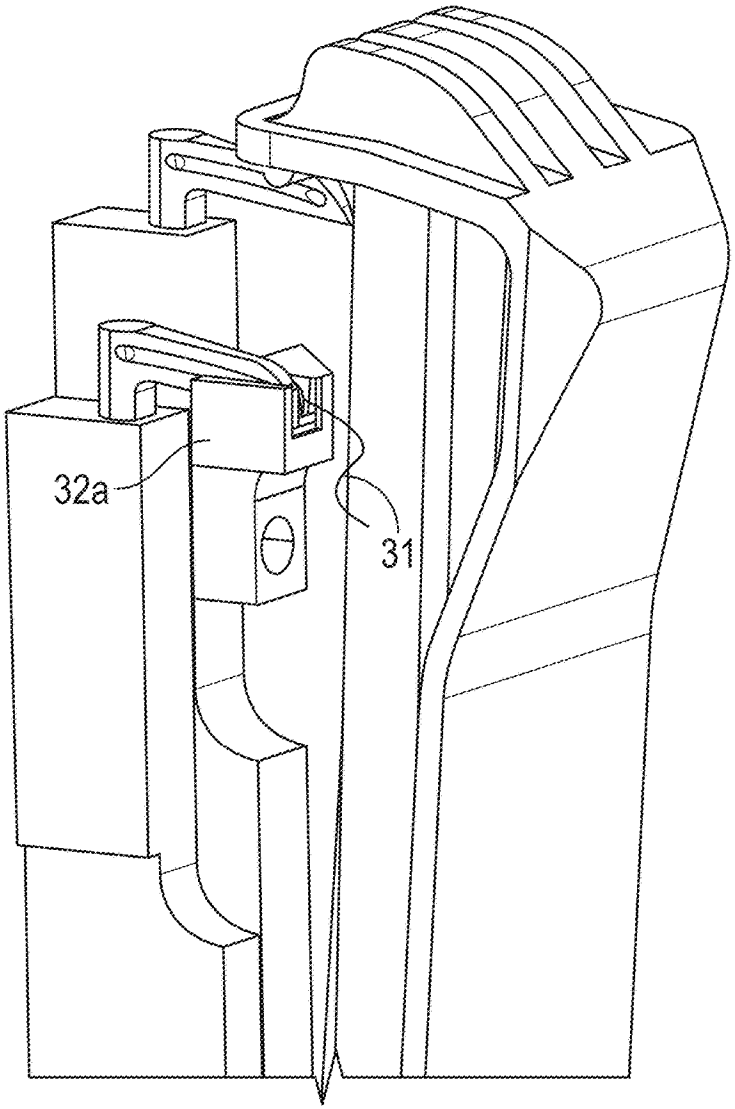
FIGS. 11 and 12 illustrate a lower post assembly modified to manage either one or two threads by automatically disabling/enabling one of the two loopers.
Figure 11:
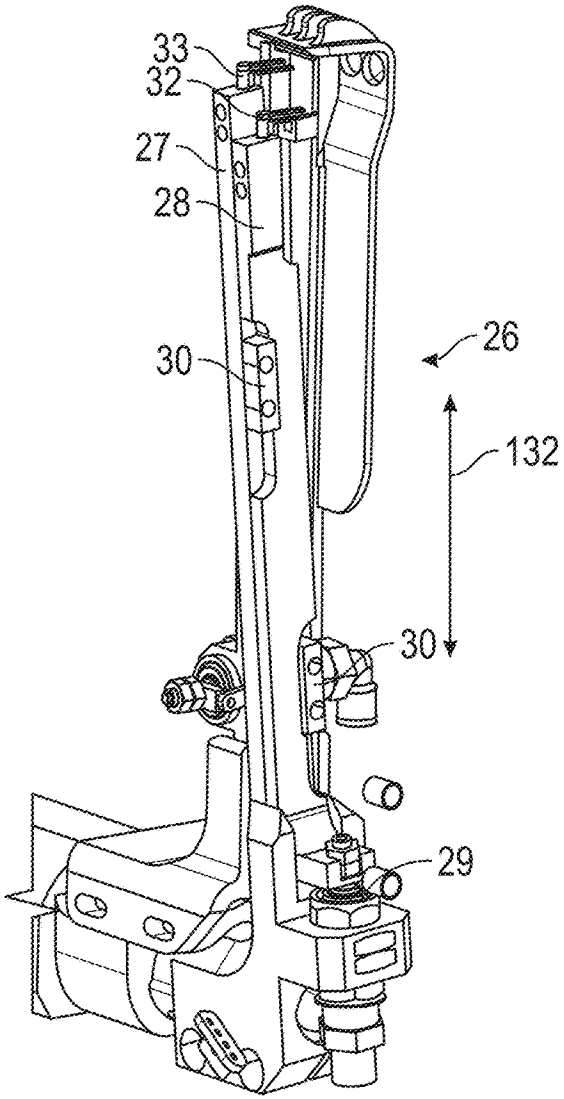

FIG. 11 and FIG. 12 illustrate a lower post assembly 26 modified to manage either one or two threads by automatically disabling/enabling one of the two loopers. The looper arm assembly includes a fixed arm 27 and a movable arm 28, each supporting one looper, with the movable arm lowered when only one needle is in use. Lowering of the movable arm is accomplished by a pneumatic cylinder 29 located near the base of the post assembly 26. The movable arm 28 is support by a pair of guides 30 that allow vertical movement of the movable arm in the direction of arrows 132 with respect to the fixed arm 27 and along a length of the fixed arm 27. Reducing the height of the movable arm 28 prevents a loose thread tail 31 protruding from the now inactive looper 32 from being sewn into the stitch created by the active looper 33. A looper nesting pocket 32*a* serves to help contain the loose thread tail.

When switching from a double needle to a single needle, the revolver needle bar holder 1 is rotated until a needle bar 7 with a single needle is in the proper position. Concurrently, one half of the looper arm is lowered to deactivate the second looper. Likewise, when switching from single needle to double needle, the revolver rotates a needle bar with two needles into position at the same time the inactive looper is raised back up to sewing position. Movements of both the needle bar revolver and looper arm half are activated automatically via a machine controller.

Additionally, the needle bars within the needle bar holder can be configured to manage a multitude of thread sizes within a single revolver. 135 tex and 210 tex thread sizes are common for decorative automotive stitching.

The ability to change size, thread color, and thread quantity automatically within a single sewing head during a single process cycle is now practically feasible.

Figure 30:
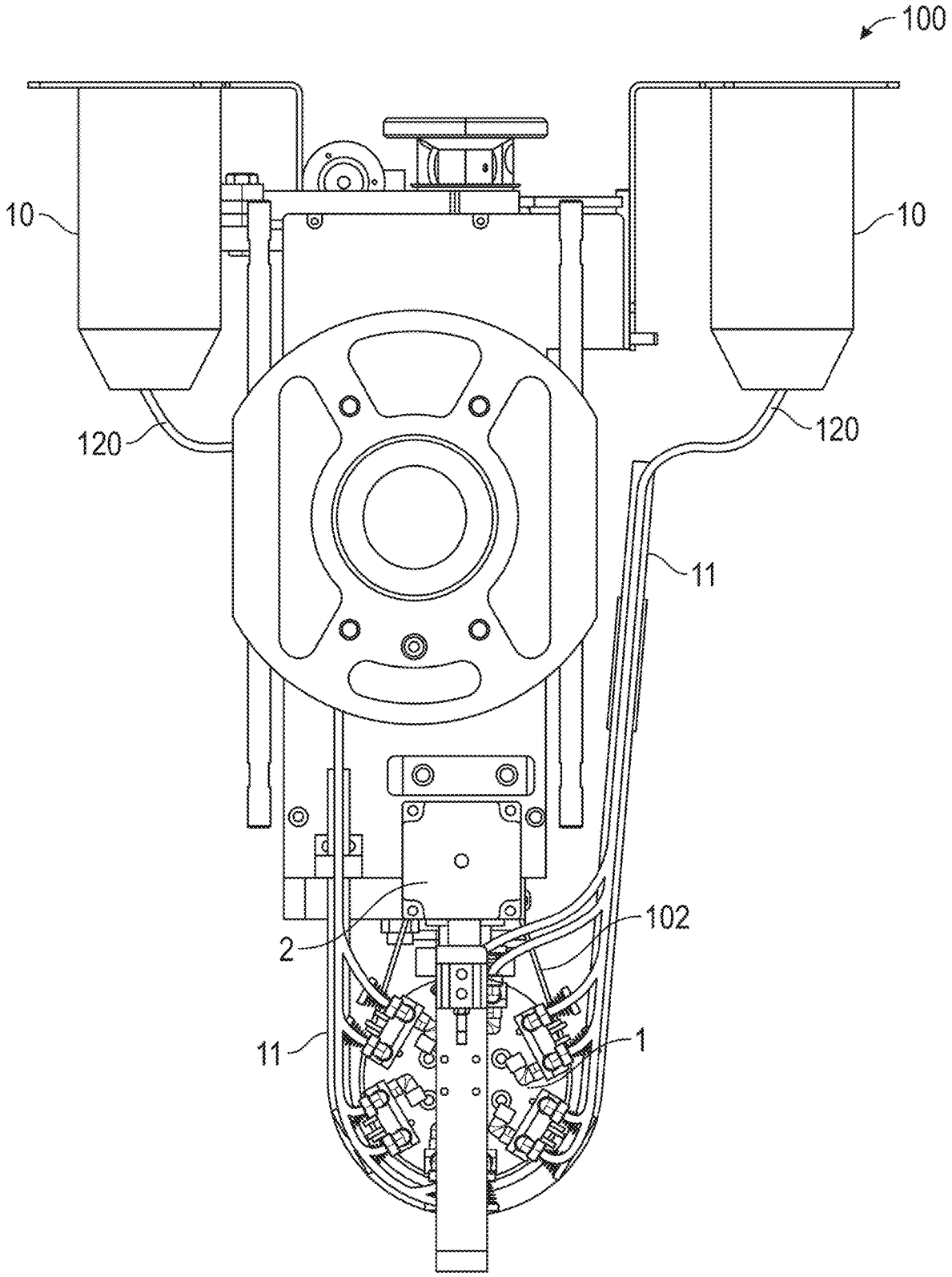
FIG. 30 is a top view of a portion of a sewing head in accordance with an embodiment of the present disclosure.

FIG. 30 is a top view of a portion of the sewing head 100 in accordance with an embodiment of the present disclosure. As mentioned above, an upper or top thread 120 is fed from individual spools 10 through tubing 11 that runs from the spools 10 to guides of the 122 of the revolver assembly 44.

Figure 31:
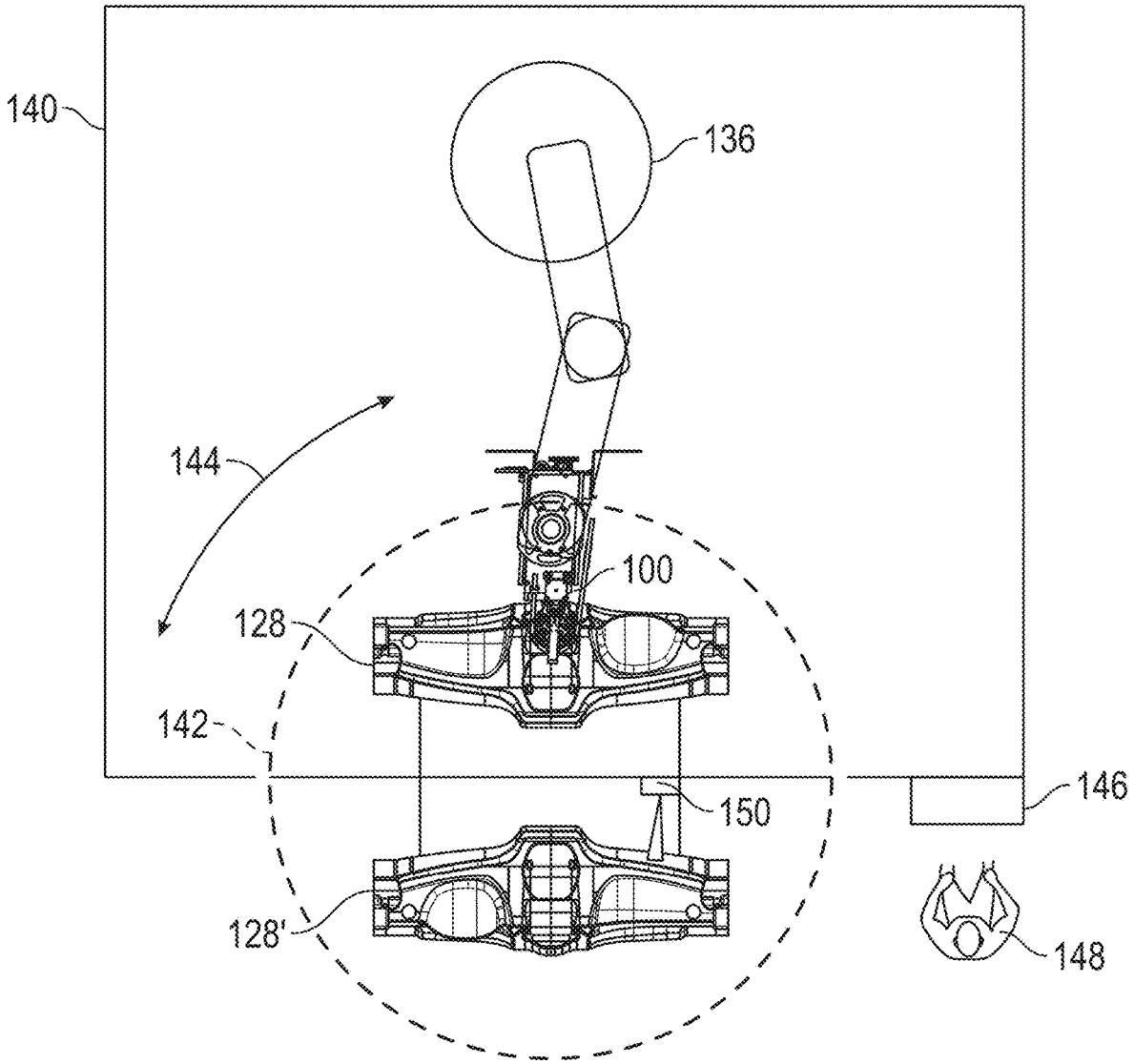
FIG. 31 is a schematic view of a robot with a sewing head in accordance with an embodiment of the present disclosure.

FIG. 31 is a schematic view of a robot 136 operably coupled to the sewing head 100 with an arm or other equivalent structure 138 of the robot 135 in accordance with an embodiment of the present disclosure. The robot 136 and the sewing head 100 are located within a cage 140. Also, shown is the part 128 that is being sewn by the sewing head 100. In addition, a second unsewn part 128' is shown waiting to be sewn by the sewing head 100. The sewn part 128 and the unsewn part 128' are located on a fixture 142 that can be rotated in at least one of the directions illustrated by arrows 144.

Also shown is a human to machine interface 146 of a computer where a user 148 can provide inputs regarding the desire thread colors. A part bar code scanner 150 is also provided to scan a bar code label of the unsewn part 128'. While the part 128 is being sewn, the unsewn part 128' is loaded on the fixture 142 located outside the cell cage 140. Upon completion of part sewing, a signal is sent to the sewing head 100 from the human machine interface (HMI) of the computer (PC) 146 indicating the thread color required for the unsewn part.

Once the unsewn part 128' is loaded but prior to rotation into the robot cage 140, a barcode label on the unsewn part 128' is scanned by the part bar code scanner 150 to verify a match of the skin color of the part 128 with the desired recipe (e.g., thread color and needled type (double or signal) selected on the human machine interface (HMI) of the computer (PC) 146.

Figure 32:
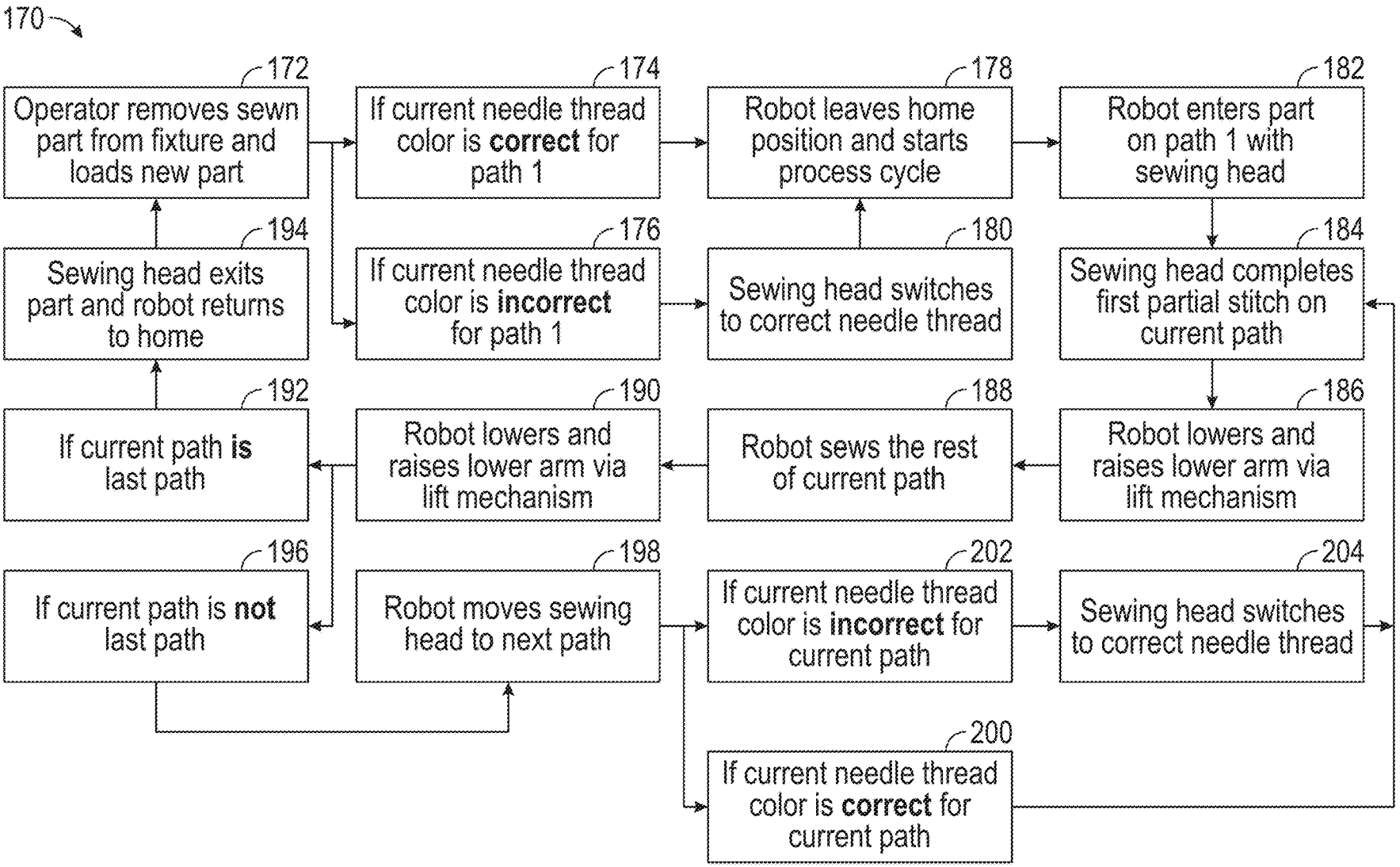
FIG. 32 is process flow chart of a sewing operation in accordance with the present disclosure.

FIG. 32 is process flow chart 170 of a sewing operation in accordance with the present disclosure. At step or box 172, an operator removes a sewn part 128 from the fixture 142 and loads new part 128'. Then it is determined whether the current needle thread color is correct for the new part. This is illustrated by boxes or steps 174 and 176. If the current needle thread color is correct, the robot 136 leaves home position and starts a first process cycle or stitch path. This is represented by box or step 178. If the current needle thread color is not correct, the sewing head 100 by rotation of the revolver switches to the correct needle thread. This is represented by box or step 180.

At box or step 182 the robot 136 enters the part 128 on a first stitch path with the sewing head 100. At box or step 184 the sewing head 100 completes a first partial stitch on the current path. If necessary and depending on the contour of the part being sewn and at box or step 186, the robot 136 lowers and raises the lower arm via a lift mechanism. Then at box or step 188, the robot 136 sews the rest of current path.

If necessary and depending on the contour of the part being sewn and at box or step 190, the robot 136 again lowers and raises the lower arm via a lift mechanism. If the current stitch path is the last path (box or step 192) the sewing head 100 exits the part 128 and the robot returns home. This is represented by boxes or steps 192 and 194.

If however, the current stitch path is not the last path (box or step 196) the robot 136 moves the sewing head 100 to the next path (box or step 198).

If the current needle thread color is correct, the robot 136 starts a first process cycle on the current stitch path. This is represented by box or steps 200 and 184. If the current needle thread color is not correct (box or step 202), the sewing head 100 by rotation of the revolver switches to the correct needle thread. This is represented by box or step 204. Then the robot 136 starts a first process cycle on the current stitch path. This is represented by box or step 184.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A needle bar holder for a sewing machine head, comprising:

a revolver configured to hold a plurality of separate needle bars;

a motor operably coupled to the revolver for rotating the revolver;

a pneumatic cylinder or electric solenoid for ensuring alignment and stability of the revolver when one of the plurality of separate needle bars are selected for a sewing process; and a pneumatically actuated lifting plate configured to engage the plurality of separate needle bars and wherein each of the plurality of separate needle bars has a needle bar clamp connected thereto, the pneumatically actuated lifting plate being connected to a pneumatic lift cylinder via a connecting rod, wherein one needle bar clamp is capable of being aligned with an opening of an upper shaft connecting rod clevis through rotation of the revolver and the pneumatically actuated lifting plate remains stationary while the revolver is rotated.

2. The needle bar holder as in claim 1, wherein the plurality of separate needle bars are six.

3. The needle bar holder as in claim 1, wherein the pneumatic cylinder or electric solenoid extends a piston that engages one of a plurality of recesses located on the revolver.

4. The needle bar holder as in claim 1, wherein the pneumatically actuated lifting plate is provided with clearance slots to allow for sliding of one of the plurality of separate needle bars with respect to the pneumatically actuated lifting plate.

5. The needle bar holder as in claim 1, wherein the plurality of separate needle bars are single or double needle bars.

6. A sewing head for a robot, comprising:

a needle bar holder, comprising:

a revolver configured to hold a plurality of separate needle bars; a motor operably coupled to the revolver for rotating the revolver;

a means for ensuring alignment and stability of the revolver when one of the plurality of separate needle bars are selected for a sewing process; and a plurality of individual spools each providing an upper thread for one of the plurality of separate needle bars, wherein the upper thread is fed from one of the plurality of individual spools through a series of guides and tensioners prior to entering a top end of the needle bar holder, wherein the upper thread that is fed from the plurality of individual spools is routed through tubing that runs from a spool mount guide bracket to a top plate of the needle bar holder, wherein the upper thread is then routed to one of a plurality of individual thread tensioners located below the top plate of the needle bar holder, and the upper thread is routed through a guide manifold after it has passed through the one of the plurality of individual thread tensioners, wherein the top plate, the plurality of individual thread tensioners and the guide manifold are configured to rotate with the revolver to eliminate thread entanglement.

7. The sewing head as in claim 6, wherein each one of the plurality of separate needle bars are hollow to serve as a conduit through which the upper thread is fed to a needle of a respective one of the plurality of separate needle bars.

8. The sewing head as in claim 6, wherein each one of the plurality of separate needle bars serves as an upper thread take up arm, creating thread slack to allow capture by a looper or hook during stitch creation.

9. The sewing head as in claim 6, wherein the plurality of separate needle bars are six.

10. The sewing head as in claim 6, wherein the means for ensuring alignment and stability of the revolver is a pneumatic cylinder or electric solenoid.

11. The sewing head as in claim 10, wherein the pneumatic cylinder or electric solenoid extends a piston that engages one of a plurality of recesses located on the revolver.

12. The sewing head as in claim 10, further comprising:

a pneumatically actuated lifting plate configured to engage the plurality of separate needle bars and wherein each of the plurality of separate needle bars has a needle bar clamp connected thereto, the pneumatically actuated lifting plate being connected to a pneumatic lift cylinder via a connecting rod, wherein one needle bar clamp is capable of being aligned with an opening of an upper shaft connecting rod clevis through rotation of the revolver and the pneumatically actuated lifting plate remains stationary while the revolver is rotated.

13. The sewing head as in claim 12, wherein the pneumatically actuated lifting plate is provided with clearance slots to allow for sliding of one of the plurality of separate needle bars with respect to the pneumatically actuated lifting plate.

14. The sewing head as in claim 10, wherein the plurality of separate needle bars are single or double needle bars.

15. The sewing head as in claim 14, further comprising:

a lower post assembly configured to manage either one or two threads by automatically disabling/enabling one of two loopers of a looper arm assembly of the lower post assembly, the looper arm assembly including a fixed arm and a movable arm, each supporting one of the two loopers, wherein the movable arm is lowered with respect to the fixed arm when a selected one of the plurality of separate needle bars is a single needle bar and lowering of the movable arm is accomplished by a pneumatic cylinder located near a base of the lower post assembly, the movable arm being supported by a pair of guides that allow vertical movement of the movable arm with respect to the fixed arm.

16. A sewing head for a robot, comprising:

a needle bar holder, comprising:

a revolver configured to hold a plurality of separate needle bars;

a motor operably coupled to the revolver for rotating the revolver;

a means for ensuring alignment and stability of the revolver when one of the plurality of separate needle bars are selected for a sewing process;

a plurality of individual spools each providing an upper thread for one of the plurality of separate needle bars, wherein the upper thread is fed from one of the plurality of individual spools through a series of guides and tensioners prior to entering a top end of the needle bar holder; and a swiper arm configured to engage a thread connected to one of the plurality of separate needle bars and wherein rotational movement of the swiper arm causes the thread to be engaged by a spring clip secured to a spring clip arm that is separately secured to the revolver.

* * * * *